US005159142A

United States Patent [19]

Ishida

[11] Patent Number: 5,159,142

[45] Date of Patent: Oct. 27, 1992

[54] ELECTRONIC MUSICAL INSTRUMENT WITH LONE MODIFICATION FOR POLYPHONIC EFFECT

[75] Inventor: Takashi Ishida, Hamamatsu, Japan

[73] Assignee: Yamaha Corporation, Hamamatsu, Japan

[21] Appl. No.: 460,522

[22] Filed: Jan. 3, 1990

[30] Foreign Application Priority Data

Jan. 6, 1989 [JP] Japan ..... 64-541

[51] Int. Cl.[5] ..... G10H 7/00; G10H 1/10

[52] U.S. Cl. ..... 84/631; 84/664; 84/625; 84/DIG. 4; 84/624

[58] Field of Search ..... 84/601, 602, 609, 615, 84/616, 618, 620, 622, 624, 625, 631, 645, 647, 653, 654, 656, 659, 660, 664, DIG. 4

[56] References Cited

U.S. PATENT DOCUMENTS 4,112,803 9/1978 Deutsch ..... 84/631
4,342,248 8/1982 Deutsch et al. ..... 84/DIG. 4 X
4,375,776 3/1983 Okamoto ..... 84/602
4,498,364 2/1985 Ezawa ..... 84/631
4,538,495 9/1985 Sato ..... 84/622
4,617,851 10/1986 Sato ..... 84/DIG. 4 X
4,813,326 3/1989 Hirano et al. ..... 84/624
4,862,783 9/1989 Suzuki ..... 84/622
4,922,796 5/1990 Kondo et al. ..... 84/618
4,926,736 5/1990 Kozuki ..... 84/609
4,939,973 7/1990 Suzuki ..... 84/605
5,044,251 9/1991 Matsuda et al. ..... 84/622 X

*Primary Examiner*—William M. Shoop, Jr.
*Assistant Examiner*—Jeffrey W. Donels
*Attorney, Agent, or Firm*—Graham & James

[57] ABSTRACT

A performance apparatus for producing a mixed musical tone signal having a comparator and a modulator. The comparator detects key data corresponding to musical tones having the same pitch and the same or similar tone colors from key data of musical tones to be mixed. The modulator changes at least a tone element of the mixed musical tone signal on the basis of the key data detected by the comparator to produce tones having multiple-tone like tone colors. The modulator comprises a detuner for detuning pitches of some musical tones of a plurality of musical tones formed based on the key data detected by the comparator, or comprises a modulator for modulating an amplitude or a frequency of the musical tone signal formed and mixed bases on the key data detected by the comparator.

12 Claims, 13 Drawing Sheets

MEMORY 63

DATA FORMAT

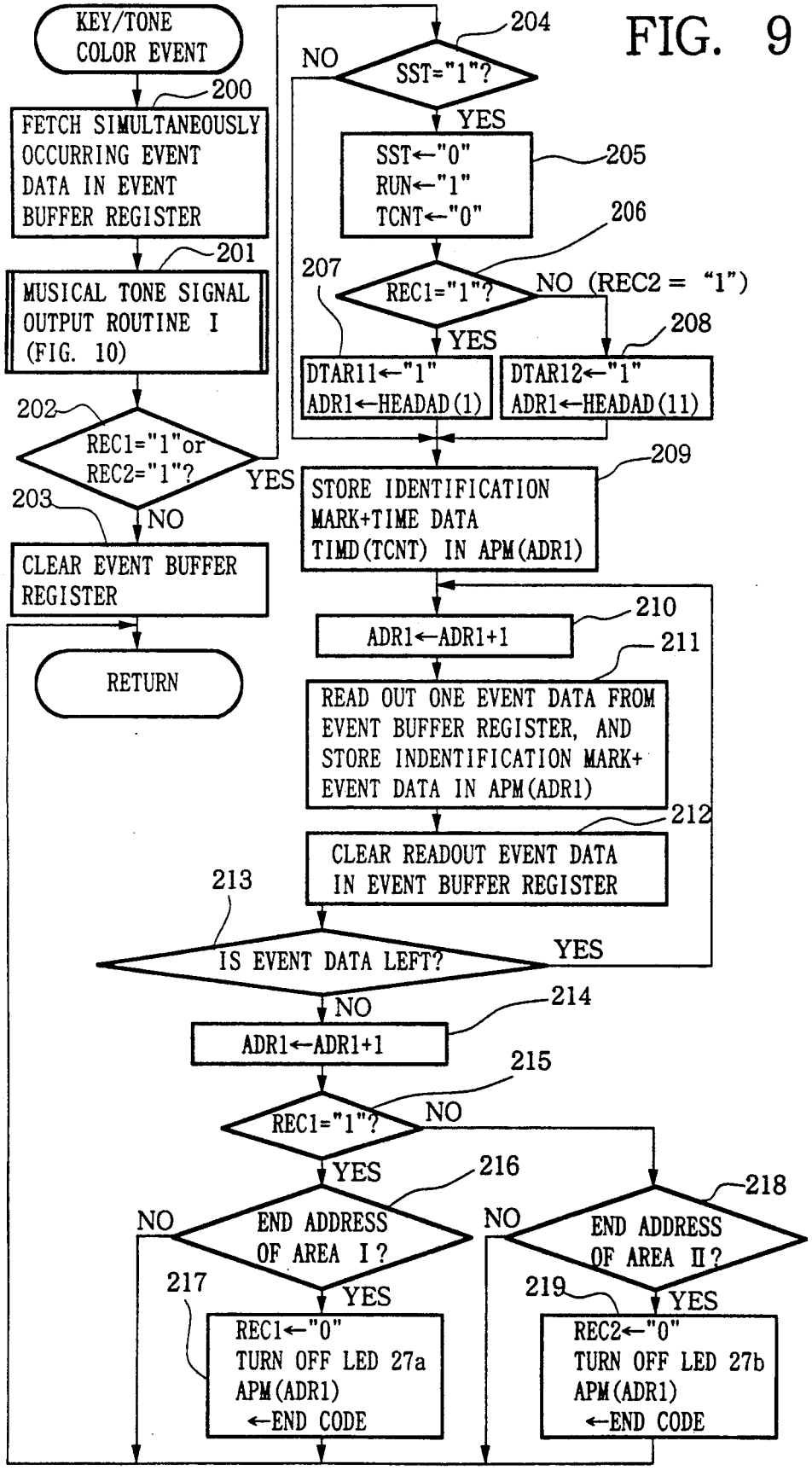
FIG. 9
KEY/TONE COLOR EVENT
200
FETCH SIMULTANEOUSLY OCCURRING EVENT DATA IN EVENT BUFFER REGISTER
201
MUSICAL TONE SIGNAL OUTPUT ROUTINE I (FIG. 10)
202
REC1="1"or REC2="1"?
YES
NO
203
CLEAR EVENT BUFFER REGISTER
RETURN
204
SST="1"?
NO
YES
205
SST←"0"
RUN←"1"
TCNT←"0"
206
207
REC1="1"?
NO (REC2 = "1")
YES
208
DTAR11←"1"
ADR1←HEADAD(1)
DTAR12←"1"
ADR1←HEADAD(11)
209
STORE IDENTIFICATION MARK+TIME DATA TIMD(TCNT) IN APM(ADR1)
210
ADR1←ADR1+1
211
READ OUT ONE EVENT DATA FROM EVENT BUFFER REGISTER, AND STORE INDENTIFICATION MARK+ EVENT DATA IN APM(ADR1)
212
CLEAR READOUT EVENT DATA IN EVENT BUFFER REGISTER
213
IS EVENT DATA LEFT?
YES
NO
214
ADR1←ADR1+1
215
REC1="1"?
NO
YES
216
END ADDRESS OF AREA I?
NO
YES
217
REC1←"0"
TURN OFF LED 27a
APM(ADR1)
←END CODE
218
END ADDRESS OF AREA II?
NO
YES
219
REC2←"0"
TURN OFF LED 27b
APM(ADR1)
←END CODE

ELECTRONIC MUSICAL INSTRUMENT WITH LONE MODIFICATION FOR POLYPHONIC EFFECT

BACKGROUND OF THE INVENTION

1. Field of the Invention

The present invention relates to a performance apparatus which can simultaneously produce a plurality of musical tones having the same pitch and the same or similar tone colors and, more particularly, to a performance apparatus with which a user can recognize a plurality of musical tones when they are mixed and are produced from one loudspeaker.

2. Description of the Prior Art

As a conventional performance apparatus, an electronic musical instrument comprising a plurality of keyboards, an automatic performance apparatus having a plurality of tone sources, and a combination of the automatic performance apparatus and the electronic musical instrument are known. In these performance apparatuses, an ensemble of keyboards, tone sources, or a manual keyboard and the automatic performance apparatuses is available.

In a performance of a plurality of, e.g., two musical instruments, even if conditions of the same timing, the same tone color, and the same pitch are satisfied, the phase relationships of musical tones formed by the two musical instruments rarely coincide with each other, thus allowing a polyphonic effect.

However, when a single performance apparatus makes performances of a plurality of musical instruments and when the conditions of the same tone color and same pitch are satisfied, musical tones to be formed have the same phase relationship during their tone generation periods. Therefore, a polyphonic effect cannot be provided, and a plurality of musical tones sound like a single musical tone. In particular, in performance apparatuses using rectangular wave tone sources described in Japanese Patent Publication No. Sho 53-3257 and Japanese Patent Laid-Open No. Sho 58-132286, such a tendency is noticeable. In the worst case, two musical tones are in perfectly opposite phases to cancel each other, and no tone can be produced although keys are depressed. For this reason, in such a performance apparatus, an ensemble by a single musical instrument is performed using different tone colors.

SUMMARY OF THE INVENTION

The present invention has been made in consideration of the conventional problems, and has as its object to provide a performance apparatus which can solely perform an ensemble using the same tone color, and with which a user can recognize a plurality of musical tones even if they have the same pitch.

As shown in FIG. 1, a performance apparatus according to the present invention comprises a musical tone forming means 1 for forming musical tone signals based on a plurality of key data, a mixing means 2 for mixing these musical tone signals, a producing means such as a loudspeaker 3 for producing the mixed musical tone signal, a comparison means 4 for detecting key data corresponding to musical tones having the same pitch and the same or similar tone colors included in the plurality of key data, and a modulation means 5 for changing at least a tone element of musical tones to be produced from the producing means on the basis of the key data detected by the comparison means 4. Here, the tone elements comprise a tone pitch, a tone color and a tone volume.

According to the present invention, every time one or a plurality of key data are input along with progress of a music piece, the musical tone forming means 1 forms musical tone signals on the basis of the key data, the mixing means 2 mixes these musical tone signals, and the loudspeaker 3 converts the output signals from the mixing means 2 into acoustic tones. Thus, musical tones are sequentially produced on the basis of the sequentially input key data.

When key data indicating musical tones having the same pitch and the same or similar tone colors are input, the comparison means 4 detects these key data, and the modulation means 5 changes at least one of the tone elements of the musical tones to be mixed and produced on the basis of the detected key data. Therefore, when a plurality of musical tones having the same pitch and same or similar tone colors are produced, they have different tone colors from those when they are sololy produced. When at least a tone color before and after the changing operation is appropriately set, a single tone can be produced to have a single-tone like monophony, and a plurality of tones can be produced to have multiple-tone like polyphony.

As the modulation means, a detune means for detuning pitches of some of musical tones detected to have the same pitch and the same or similar tone colors can be used. In this case, musical tones which are mixed and produced have a beat based on a pitch difference, and sound like a plurality of tones.

As another modulation means, a means for amplitude- or frequency-modulating some of musical tones or mixed musical tones detected to have the same pitch and the same or similar tone colors may be used.

As described above, according to the performance apparatus of the present invention, a user can execute an ensemble using the same or similar tone colors by a single apparatus without experiencing that a plurality of tones having the same pitch and the same or similar tone colors to be produced sound like a single tone.

BRIEF DESCRIPTION OF THE DRAWINGS

FIGS. 6 to 17 are flow charts corresponding to programs by a microcomputer shown in FIG. 2.

DETAILED DESCRIPTION OF THE PREFERRED EMBODIMENTS

An embodiment of the present invention will now be described with reference to the accompanying drawings.

Arrangement of Embodiment

Figure 1:
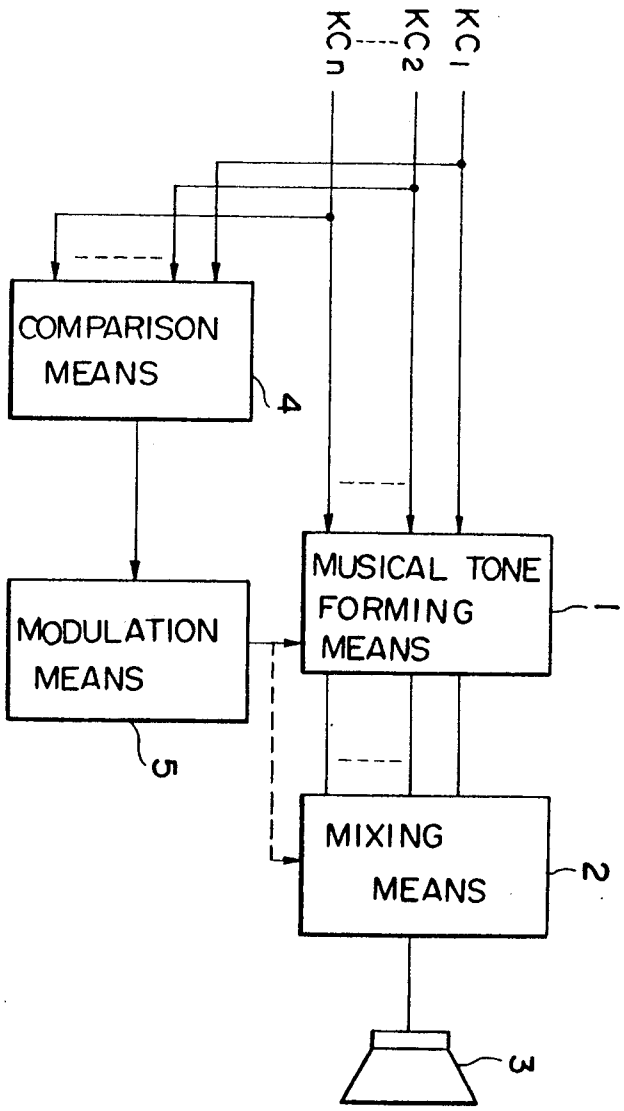
FIG. 1 is a block diagram corresponding to a description of appended claims.
Figure 2:
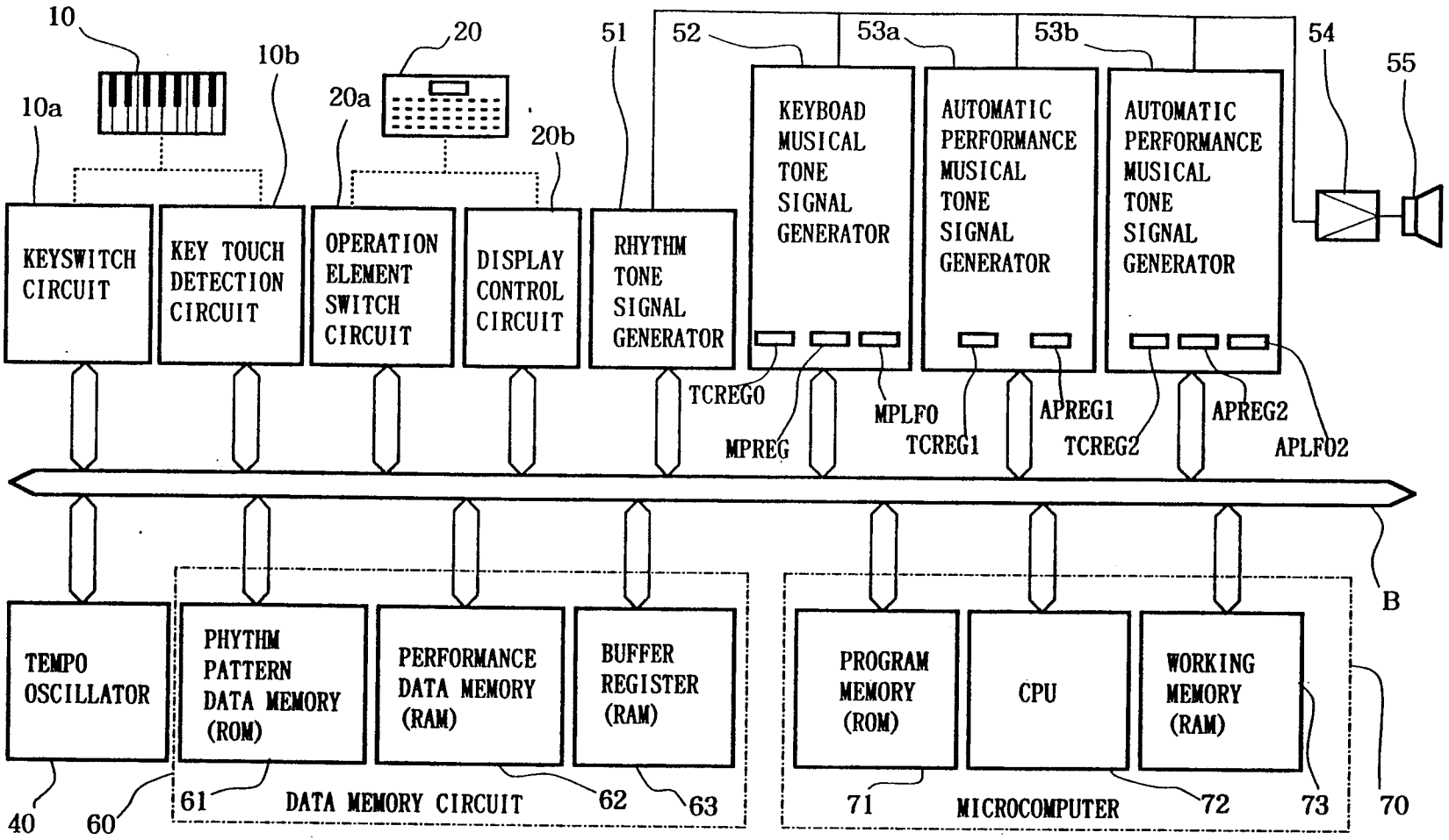
FIG. 2 is a block diagram showing a performance apparatus according to an embodiment of the present invention.

FIG. 2 shows a hardware arrangement of a performance apparatus according to an embodiment of the present invention. In this performance apparatus, the present invention is applied to an automatic performance apparatus which can execute an ensemble of a total of three parts, i.e., one part of a manual (keyboard) performance and two parts of automatic performances. However, when musical tones having the same pitch and the same tone color are performed in two or more parts, they may sound like a single tone. In contrast to this, in this embodiment, when generation of musical tones having the same pitch and same tone color is designated in two parts, the pitch of a musical tone in one part is detuned slightly (e.g., 2 to 3 cents), so that two tones sound as two tones. When three tones are designated to have the same pitch and same tone color, one tone is detuned to be higher and another tone is detuned to be lower, thereby separating three tones.

The performance apparatus shown in FIG. 2 comprises a keyboard 10 and an operation panel 20. The keyboard 10 includes a plurality of keys for designating musical tones. Key-ON/OFF events of the keys are detected by ON/OFF states of a plurality of key switches arranged in a key switch circuit 10*a* in correspondence with the keys. Upon key-ON events of the keys, key touch sensors arranged in a key touch detection circuit 10*b* in correspondence with the keys are operated. These key touch sensors detect initial key touch data such as key-ON speeds, key-ON pressures, and the like. The key switch circuit 10*a* and the key touch detection circuit 10*b* are connected to a bus B.

Figure 3:
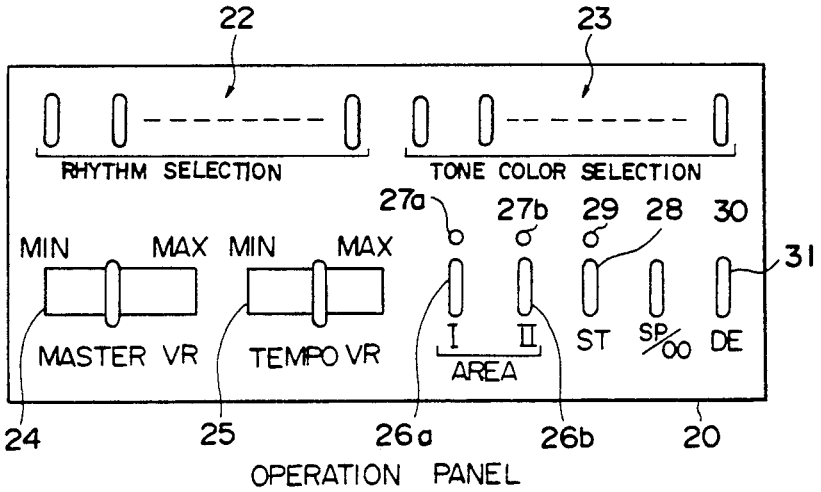
FIG. 3 is a top view showing in detail an outer appearance of an operation panel 20 shown in FIG. 2.

As shown in FIG. 3, the operation panel 20 includes rhythm selection switches 22 for selecting types of rhythm, such as "8-beat", "samba", and the like, tone color selection switches 23 for selecting tone colors such as "piano", "flute", and the like, a master volume control 24 for adjusting a tone volume of musical tones to be produced, a tempo volume control 25 for adjusting a tempo of musical tones to be produced, track switches 26*a* and 26*b* for designating memory areas, LEDs (light-emitting diodes) 27*a* and 27*b* arranged above these track switches 26*a* and 26*b*, a start switch 28 for instructing start of an automatic performance or recording of performance data, an LED 29 arranged above the start switch 28, a stop/continue switch 30 for instructing to stop an automatic performance or recording of performance data, and to restart the stopped automatic performance, and a delete switch 31 for instructing to delete performance data in a memory. An operation element switch circuit 20*a* converts the outputs from these switches into codes, and outputs the codes onto the bus b. A display control circuit 20*b* ON/OFF-controls the LEDs 27*a*, 27*b*, and 29.

The bus B is connected to a tempo oscillator 40, a rhythm tone signal generator 51, a keyboard musical tone signal generator 52, an automatic performance I musical tone signal generator 53*a*, an automatic performance II musical tone signal generator 53*b*, a data memory circuit 60, and a microcomputer 70. The tempo oscillator 40 outputs a tempo clock signal as a rhythm interrupt signal to the microcomputer 70 through the bus B in accordance with preset tempo data. The rhythm tone signal generator 51 has a plurality of percussion tone signal formation channels for forming percussion tone signals corresponding to percussions such as a cymbal, a bass drum, and the like, and forms and outputs tee percussion tone signals in accordance with rhythm pattern data supplied from the microcomputer 70 through the bus B.

The keyboard musical tone signal generator 52 and the automatic performance musical tone signal generators 53*a* and 53*b* for the automatic performance comprise a plurality of musical tone signal formation channels for forming musical tone signals corresponding to musical instruments such as piano, a violin, and the like. The keyboard musical tone signal generator 52 forms and outputs musical tone signals on the basis of performance data supplied from the microcomputer 70 through the bus B in accordance with key-ON/OFF events at the keyboard 10, operations of the tone color selection switches 23, and the like. The automatic performance musical tone signal generators 53*a* and 53*b* form and output musical tone signals on the basis of automatic performance data which are stored in the data memory circuit 60, read out by the microcomputer 70, and supplied through the bus B. Musical tone signals from the rhythm tone signal generator 51, the keyboard musical tone signal generator 52, and the automatic performance musical tone signal generators 53*a* and 53*b* are mixed and supplied to an amplifier 54. The output terminal of the amplifier 54 is connected to a loudspeaker 55. The loudspeaker 55 produces musical tones corresponding to the musical tone signals supplied from the amplifier 54. These musical tone generators 52, 53*a*, and 53*b* have the following registers for storing tone color data, pitch data, and the like supplied from the Microcomputer 70 through the bus B as musical tone signal generation data.

Tone color data registers TCREG0, and TCREG1. . . TCREG2. . .

One MP (manual performance) tone color data register TCREG0 is arranged in the keyboard musical tone signal generator 52, and stores tone color data selected upon operation of the tone color selection switches 23. An AP1 (automatic performance I) tone color data register TCREG1 and an AP2 (automatic performance II) tone color data register TCREG2 are arranged in each of the automatic performance musical tone signal generators 53*a* and 53*b* and store automatic performance I and II tone color data supplied from the microcomputer 70 through the bus B.

Pitch data registers MPREG, APREG1, and APREG2. . .

An MP pitch data register MPREG is arranged in the keyboard musical tone signal generator 52, and stores ON-key pitch data at the keyboard 10 until a key-OFF event of the corresponding key is detected. An AP1 pitch data register APREG1 is arranged in the automatic performance musical tone signal generator 53*a*, and stores key code data (pitch data) from when automatic performance I key-ON data is read out from the data memory circuit 60 by the microcomputer 70 until key-OFF data of the corresponding key is read out. An AP2 pitch data register APREG2 similarly stores automatic performance II pitch data from key-ON until key-OFF. Each of these pitch data registers MPREG, APREG1, and APREG2 is arranged to have one-to-one correspondence with each musical tone formation channel. More specifically, these pitch data registers each corresponding in number to the maximum number of tones to be simultaneously produced (e.g., eight tones each) are arranged in the musical tone signal generators 52, 53*a*, and 53*b*.

Detune amount data registers MPLFO and APLFO2. . .

MP detune amount data registers MPLFO corresponding in umber to the musical tone formation channels are arranged in the keyboard musical tone signal generator 52. Each register MPLFO stores a detune amount (correction amount $-\alpha$) of pitch data MPREG of a musical tone signal to be formed in the corresponding musical tone formation channel. AP detune amount data registers APLFO2 corresponding in number to the musical tone formation channels are arranged in the AP2 musical tone signal generator 53*b*. Each register APLFO2 stores a detune amount ($+\alpha$) of pitch data APREG2 of a musical tone signal to be formed in the corresponding musical tone formation channel. These detune amounts MPFLO and APLFO2 are set by the microcomputer 70 in accordance with a combination of MP, AP1, and AP2 musical tones when they are designated to have the same pitch (MPREG, APREG1, and APREG2) and the same tone color (TCREG0, TCREG1, and TCREG2).

Figure 4:
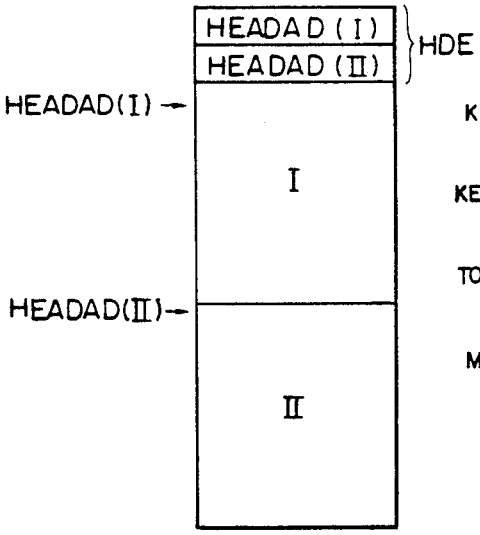
FIG. 4 is a view for explaining storage areas of a performance data memory 63 shown in FIG. 2.
Figure 5:
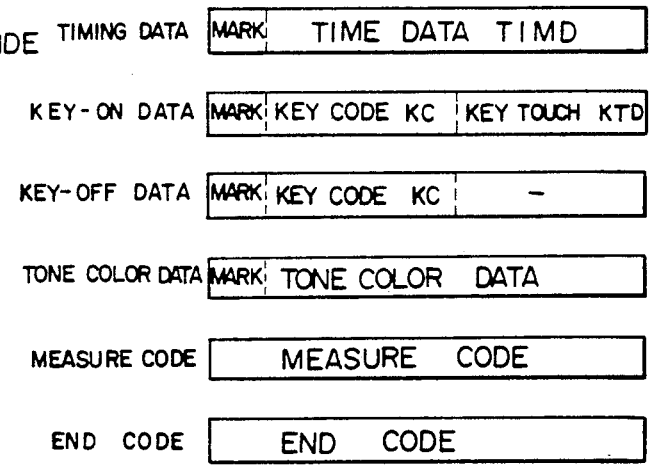
FIG. 5 shows formats of various performance data stored in the performance data memory 63 shown in FIG. 2.

The data memory circuit 60 Comprises a rhythm pattern data memory 61, a performance data memory 62, and a buffer register memory 63, which are connected to the bus B. The rhythm pattern data memory 61 comprises s ROM, and time-serially stores rhythm pattern data for instructing the rhythm tone signal generator 51 to form and output percussion tone signals over one measure length in units of rhythm types. The performance data memory 62 comprises a RAM, and has storage areas I and II having the same storage capacity, and a head data area HDE, as shown in FIG. 4. The head data area HDE stores a start address HEADAD(I) of the area I, and a start address (II) of the area II. The areas I and II have a large number of storage positions APM(ADR) addressed by addresses ADR (to be described later). At the storage positions APM(ADR), the following various automatic performance data are stored with data formats as shown in FIG. 5.

Timing data. . . Consists of an identification mark indicating timing data, and time data TIMD indicating an elapse time from the head of a measure.

Key-ON data. . . consists of an identification mark indicating key-ON event data at the keyboard 10, and a key code KC representing a key-ON key.

Key-OFF data. . . consists of an identification mark indicating key-OFF event data at the keyboard 10, and a key code KC representing a key-OFF key.

Tone Color data. . . consists of an identification mark indicating tone color data selected by the corresponding tone color selection switch 23, and the selected tone color data.

Measure code. . . indicates that a progress timing of an automatic performance is a timing corresponding to a bar.

End code. . . indicates an end timing of an automatic performance.

The buffer register memory 63 comprises a RAM, and is provided with an event buffer register IVTBUF having a plurality of storage positions IVTBUF(A) for temporarily storing events at the keyboard 10 and the tone color selection switches 23.

The microcomputer 70 comprises a program memory 71, a CPU 72, and a working memory 73, which are connected to the bus B. The program memory 71 comprises a ROM, and stores a main program, a rhythm interrupt program, and their subprograms corresponding to the flow charts shown in FIGS. 6 to 15. The CPU 72 starts execution of the main program upon power-on of a power switch (not shown), and repetitively executes the main program until the power switch is OFF. When the tempo clock signal is input from the tempo oscillator 40, the CPU 72 interrupts execution of the main program, and executes the rhythm interrupt program. The working memory 73 comprises a RAM, and temporarily stores a plurality of data and flags necessary for execution of the programs. Principal ones of these data and flags are as follows;

Rhythm run flat RUN. . . When this flag RUN is set "1", a rhythm tone is generated; when it is set "0", a rhythm tone is stopped.

Play flags PLY1 and PLY2. . . When the flag PLY1 is set "1", an automatic performance enable state based on performance data in the area I of the performance data memory is set. When the flag PLY1 is set "1" and the start switch 28 is then depressed, an automatic performance is started. Similarly, when the flag PLY2 is set "1", an automatic performance enable state based on performance data in the area II of the performance data memory is set.

Record flags REC1 and REC2. . . When the flag REC1 is set "1", a data write enable state of the area I of the performance data memory 62 is set. When the start switch 28 or a key of the keyboard 10 is depressed after the flag REC1 is set "1", write access of the area I is started. Similarly, when the flag REC2 is set "1", a data write enable state of the area II is set.

Synchro start flag SST. . . When the flag SST is set "1", a rhythm tone is started simultaneously with an operation of a key of the keyboard at the beginning of write access of performance data. More specifically, synchronous start of a rhythm tone is allowed.

Record check flags DTARI1 and DTARI2. . . When data is written in the area I of the performance data memory 62, the flag DTARI1 is set "1"; when data is written in the area II, the flag DATARI2 is set "1".

Stop reserve flag SRF. . . When the flag SRF is set "1" during an automatic performance, the automatic performance is stopped at a timing of the next bar. When the flag SRF is set "1" in a data write mode, the end code is written in the performance data memory 62 at a timing of the next bar, thus ending data write access.

Address data ADR1 and ADR2. . . These address data are output to the address terminal of the performance data memory 62. Addresses of the area I are designated by the address data ADR1, and addresses in the area II are designated by the address data ADR2.

Mode data M1 and M2. . . Every time the track switch 26*a* is depressed, the mode data M1 is cyclically changed like 1→2→0→1→. . . In accordance with the mode data M1, the operation mode is determined as follows:

1=. automatic performance mode of area I
2=. data write mode of area I
0=. normal performance mode Similarly, every time the track switch 26*b* is depressed, the mode data M2 is cyclically changed. In accordance with the mode data M2, the operation mode is determined as follows:

1=. automatic performance mode of area II
2=. data write mode of area II
0=. normal performance mode Tempo count data TCNT. . . The data TCNT is incremented every time the tempo oscillator 40 outputs the tempo clock signal. When the data TCNT reaches "48", it is reset to "0". More specifically, the tempo count data TCNT repetitively counts the tempo clock signals between "0" to "48". The tempo count data TCNT indicates a progress timing of one measure, and when this data TCNT reaches "48" (=0), a timing of a bar is reached.

Read data RDDT1 and RDDT2. . . The read data RDDT1 is data read out from the area I of the performance data memory, and the read data RDDT2 is data read out from the area II.

Read timing data RDTIM1 and RDTIM2. . . The read timing data RDTIM1 is read timing data of those read out from the area I, and the read timing data RDTIM2 is read timing data of those read out from the area II.

Tone color event data TC. . . The data TC represents a new tone color selected upon operation of the tone color selection switch 23. This data is read out from the event buffer register IVTBUF in the buffer register memory 63.

Tone one color comparison data TCSAME. . . The data TCSAME is set as follows in accordance with combinations of tone colors among a manual performance (MP) mode, the automatic performance I (AP1) mode, and the automatic performance II (AP2) mode:

0=. all the tone colors are different
1=. tone colors in MP and AP1 are the same
2=. one colors in AP1 and AP2 are the same
3=. one colors in MP and AP2 are the same
4=. all the tone colors in MP, AP1, and AP2 are the same Key event data KBUF. . . The data KBUF are key-ON or key-OFF data representing a new key-ON key at the keyboard 10. The data KBUF is read out from the storage position IVTBUF(A), designated by a control variable A, of a plurality of event buffer registers IVTBUF arranged in the buffer register memory 63.

Operation of Embodiment

The operation of the performance apparatus with the above arrangement will be described below with reference to the flow charts shown in FIGS. 6 to 17.

(1) Normal Performance Mode

Figure 6:
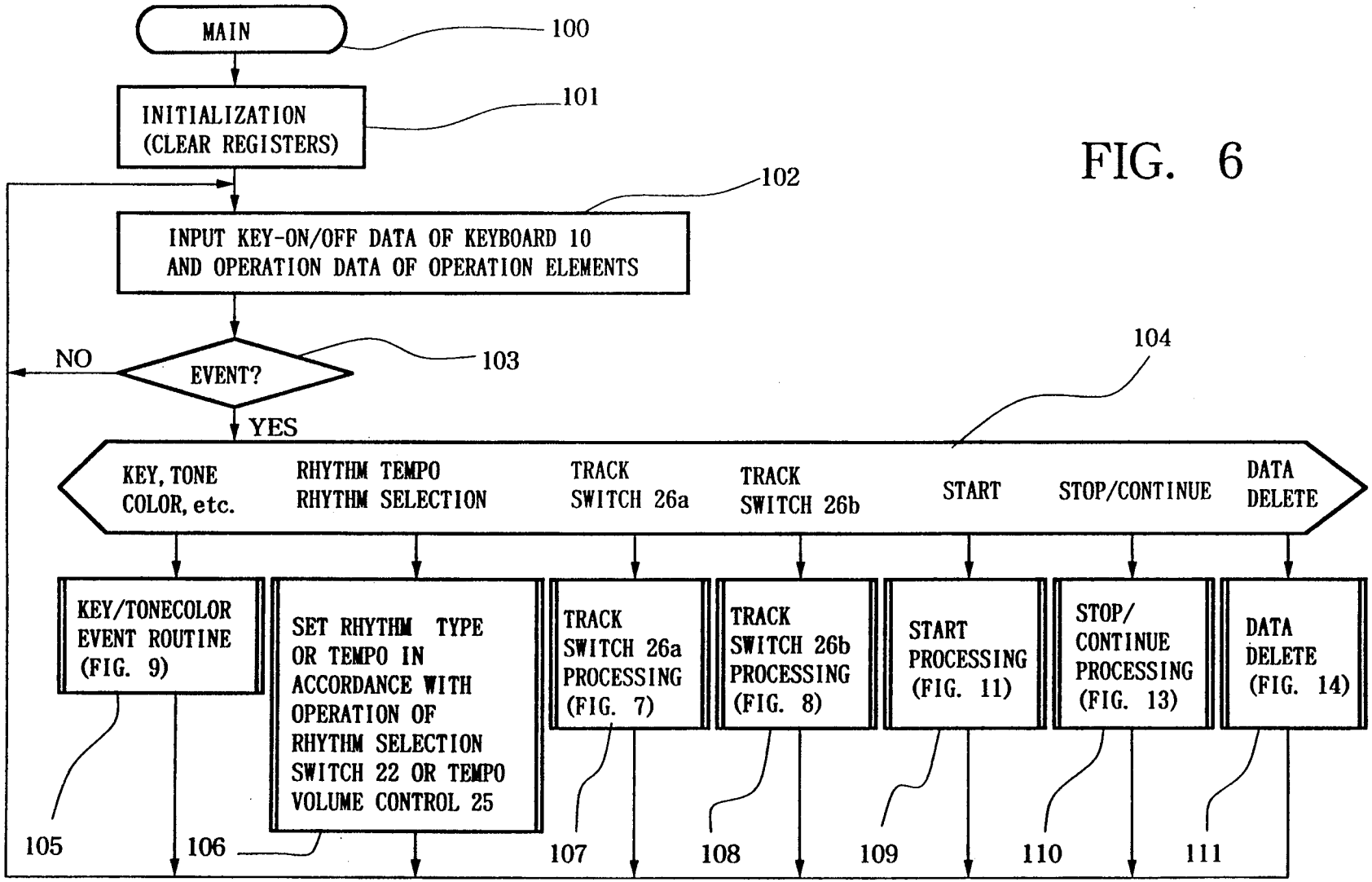

In this performance apparatus, when the power switch (not shown) is turned on, the CPU 72 executes the main program in step 100 in FIG. 6, and clears registers and flags in the working memory 73 in step 101, thereby initializing the microcomputer 70. After the initialization, the CPU 72 scans the key switches in the key switch circuit 10*a* and the operation elements in the operation element switch circuit 20*a* to load key-ON/OFF data associated with the keyboard 10 and operation data of the operation elements associated with the operation panel 20 through the bus B in step 102. In step 103, the CPU 72 detects the presence/absence of the key-ON/OFF event at the keyboard 10 or the operation event at the operation panel 20 using the working memory 73 on the basis of the loaded key-ON/OFF data and the operation data. Assuming that no keys at the keyboard 10 are operated and no operation elements at the operation panel 20 are operated, the CPU 72 determines NO, i.e., no event in step 103, and returns the program to step 103. Thus, the CPU 72 repetitively executes loop processing of steps 102 and 103.

Figure 7:
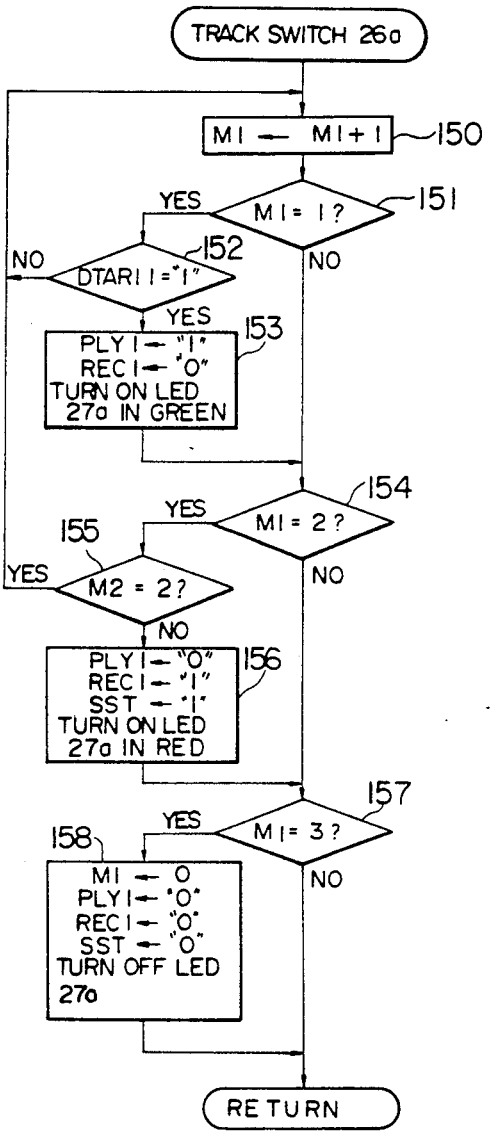

When a performer depresses the track switch 26*a*, YES is obtained in step 103, and the flow advances to step 104. In step 104, the type of event is discriminated. In this case, since the ON-event of the track switch 26*a* is detected, the flow advances to the processing in step 107. FIG. 7 is the flow chart showing the processing in step 107. In step 150, the mode data M1 is incremented. The flow then advances to step 151 to check if the mode data M1 is "1". If YES in step 151, the flow advances to step 152; otherwise, the flow advances to step 154. In step 152, it is checked if the record check flag DTARI1 is "1". If YES in step 152, the flow advances to step 153; otherwise, the flow returns to step 150.

In step 153, the play flag PLY1 is set "1" and the record flag REC1 is set "0" to turn on the LED 27*a* in green. The flow then advances to step 154. In step 154, it is checked if the mode data M1 is "2". If YES in step 154, the flow advances to step 155; otherwise, the flow advances to step 157. It is checked in step 155 if the mode data M2 is "2". If YES in step 155, the flow returns to step 150; otherwise, the flow advances to step 156. In step 156, the play flag PLY1 is set "0", and the record flag REC1 and the synchro start flag SST are respectively set "1". In addition, the LED 27*a* is turned on in red. The flow then advances to step 157. It is checked in step 157 if the mode data M1 is "3". If NO in step 157, the flow returns to step 102 in FIG. 6; otherwise, the flow advances to step 158. In step 158, the mode data M1 is set "0", and the play flag PLY1, the record flag REC1, and the synchro start flag SST are respectively cleared. In addition, the LED 27*a* is turned off. The flow then returns to step 102.

As can be seen from the above processing, every time the track switch 26*a* is depressed, the mode data M1 is incremented (step 150). When the mode data M1 becomes "3", it is reset to "0" in step 158. More specifically, every time the track switch 26*a* is depressed, the mode data M1 is sequentially changed like 0→1→2→0→. . . In accordance with the value of the mode data M1, the flags are set, and the LED 27*a* is turned on/off (steps 153, 156, and 158), thus determining the operation mode.

When the mode data M1 is "1" (automatic performance mode) and when no performance data is written in the area I of the memory 62, NO is determined in step 152, and the flow returns to step 150 to set the mode data M1 to be "2". More specifically, when no performance data is written in the area I, the mode data M1 is changed from "0" to "2" while skipping "1", and hence, the mode data M1 cannot be set "1. When the mode data M1 is "2" (data write mode), and when the mode data M2 set by the track switch 26*b* has already been set "2", YES is determined in step 155, and the flow returns to step 150 to increment the mode data M1 again. More specifically, when the mode data M2 is "2", the mode data M1 is inhibited from being set "2" to prevent the same data from being repetitively written in the areas I and II.

Figure 8:
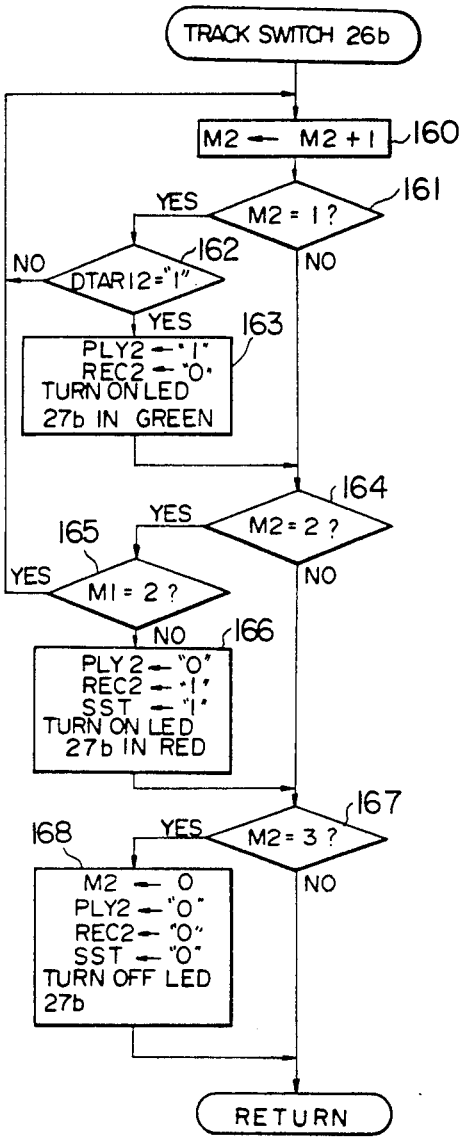

The processing of the CPU 72 when the track switch 26*a* is operated has been described. On the other hand, when the track switch 26*b* is operated, the flow advances from step 104 in FIG. 6 to step 108. FIG. 8 shows the processing in step 108. Note that this processing is substantially the same as that in FIG. 7 described above except that a suffix "1" is replaced with "2" like M1→M2, and its description will be omitted.

When the LEDs 27*a* and 27*b* are set OFF upon operation of the track switche 26*a* and 26*b*, the play flags PLY1 and PLY2 and the record flags REC1 and REC2 are set "0" (see step 158 in FIG. 7 and step 168 in FIG. 8), thus setting the normal performance mode. In this mode, when a performer makes a performance using the keyboard 10 and the operation panel 20, musical tones as he designated are produced from the loudspeaker 55.

More specifically, when a key at the keyboard 10 is depressed, YES is determined in step 103 in FIG. 6, and the control enters a key/tone color event routine in step 105 via step 104. FIG. 9 is a flow chart showing the key/tone color event routine. In step 200, simultaneously occurred event data are fetched in the event buffer register IVTBUF in the buffer memory 63. More specifically, in this case, key-ON data (FIG. 5) consisting of the key code KC, the key touch data KTD, and the identification mark of the ON key is fetched in the event buffer register IVTBUF. Note that events of the same type detected during execution of one loop processing in steps 102 and 103 by the CPU 72 are processed as those occurred at the same time. A tone color and a key are detected at different timings.

Figure 10:
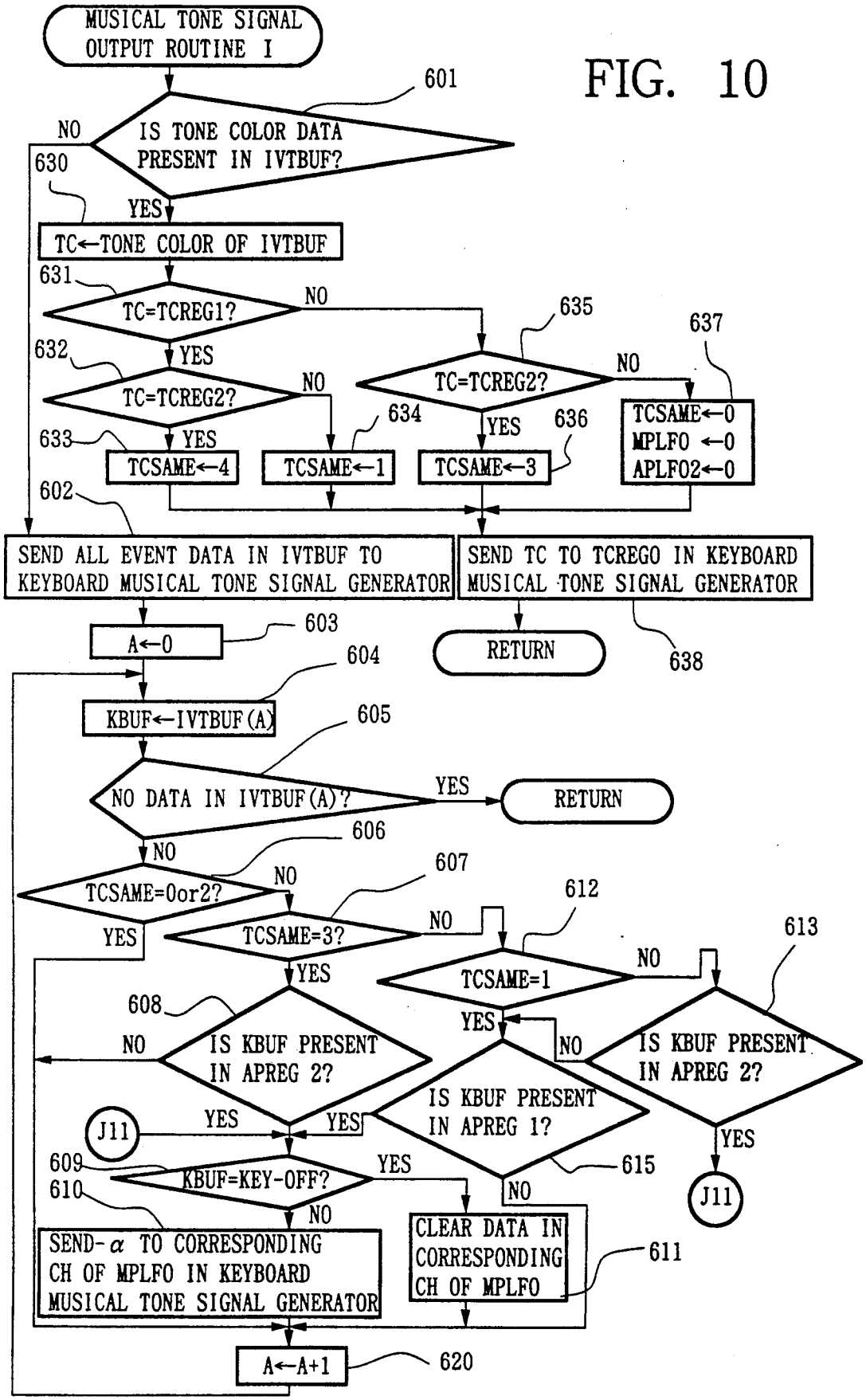

The flow then advances to a musical tone signal output routine I in step 201. FIG. 10 is a flow chart of the musical tone signal output routine I. In step 601, it is checked if the event buffer register IVTBUF holds tone color data. In this case, NO is determined in step 601, and the flow advances to step 602. In step 602, all the event data in the event buffer register IVTBUF are sent to the MP pitch data register MPREG in the keyboard musical tone signal generator 52. In this case, the key ON data in the event buffer register IVTBUF is sent to the register MPREG. In this case, the key-ON data in the event buffer register IVTBUF is sent to the register MPREG. Thus, a musical tone corresponding to the ON key is generated. When the flow advances to step 603, the control variable A is cleared, and detune processing I in steps 604 to 629 is then executed. Thereafter, the flow returns to step 202 in FIG. 9. In the detune processing I, processing which is valid only in the automatic performance mode, i.e., only when at least one of the LEDs 27*a* and 27*b* is turned on in green is executed. The detune processing I will be described later.

In step 202 (FIG. 9), it is checked if the record flag REC1 or REC2 is "1". In this case, NO is determined in step 202, and the flow advances to step 203. In step 203, the event buffer register IVTBUF is cleared. The flow then returns to step 102 in FIG. 6.

When a key-OFF event of the keyboard 10 is detected, the flow advances from step 103 to step 200 (FIG. 9) via step 104 in the same manner as described above, and key-OFF data consisting of the key code KC and the identification mark of the OFF key is fetched in the event buffer register IVTBUF. The flow advances to step 602 in the musical tone signal output routine I (FIG. 10). In step 602, the key-OFF data is sent to the MP pitch data register MPREG in the keyboard musical tone signal generator 52. Thus, the register MPREG is cleared, and production of a tone corresponding to the OFF key is stopped. The flow then returns to step 102 via steps 202 and 203.

When one of the tone color selection switches 23 is operated, data indicating the operated switch is fetched in the event buffer register IVTBUF in step 200. The flow advances to the musical tone signal output routine I in step 201. YES is then determined in step 601, and tone color comparison processing I in steps 630 to 637 is executed. Thereafter, the flow advances to step 638. In the tone color comparison processing I, processing which is valid only in the automatic performance mode, i.e., only when at least one of the LEDs 27*a* and 27*b* is turned on in green is executed. The tone color comparison processing I will be described later. In step 638, data fetched in the event buffer register IVTBUF is sent to the MP tone color data register TCREG0 in the keyboard musical tone signal generator 52. Thus, the tone color corresponding to the operated tone color selection switch is set in the keyboard musical tone signal generator 52. Similarly, when the master volume control 24 is operated, data indicating an operation amount of the master volume control 24 is set in the keyboard musical tone signal generator 52, thus updating a tone volume of a musical tone.

Figure 11:
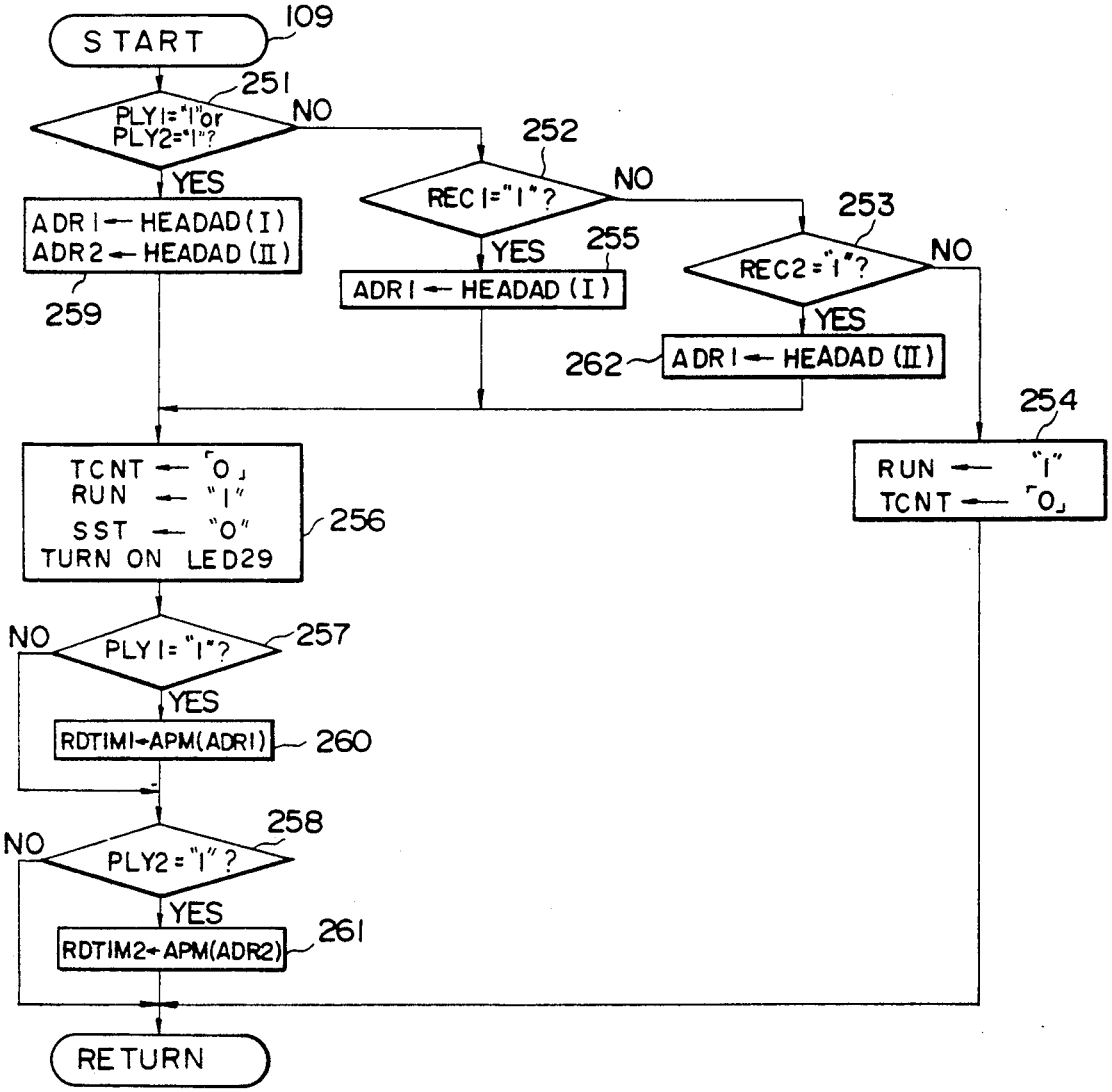

When a rhythm tone is to be generated, the start switch 28 is depressed. When the start switch 28 is depressed, YES is determined in step 103, and the flow advances to a start processing routine in step 109 via step 104. FIG. 11 is a flow chart showing the start processing routine. In step 251, it is checked if the play flag PLY1 or PLY2 is "1". In this case, since NO is determined in step 251, the flow advances to step 252 to check if the record flag REC1 is "1". In this case, NO is determined in step 252, and the flow advances to step 253. It is checked in step 253 if the record flag REC2 is "1". Since NO is determined in step 253, the flow advances to step 254. In step 254, the rhythm run flag RUN is set "1", and the tempo count data TCNT is cleared. The flow then returns to step 102 (FIG. 6).

In this manner, when the start switch 28 is depressed in the normal performance mode, the rhythm run flag RUN is set "1", and the tempo count data TCNT is cleared. When the flag RUN is set "1", rhythm tones are formed and produced on the basis of the tempo clock signals output from the tempo oscillator 40.

Figure 12:
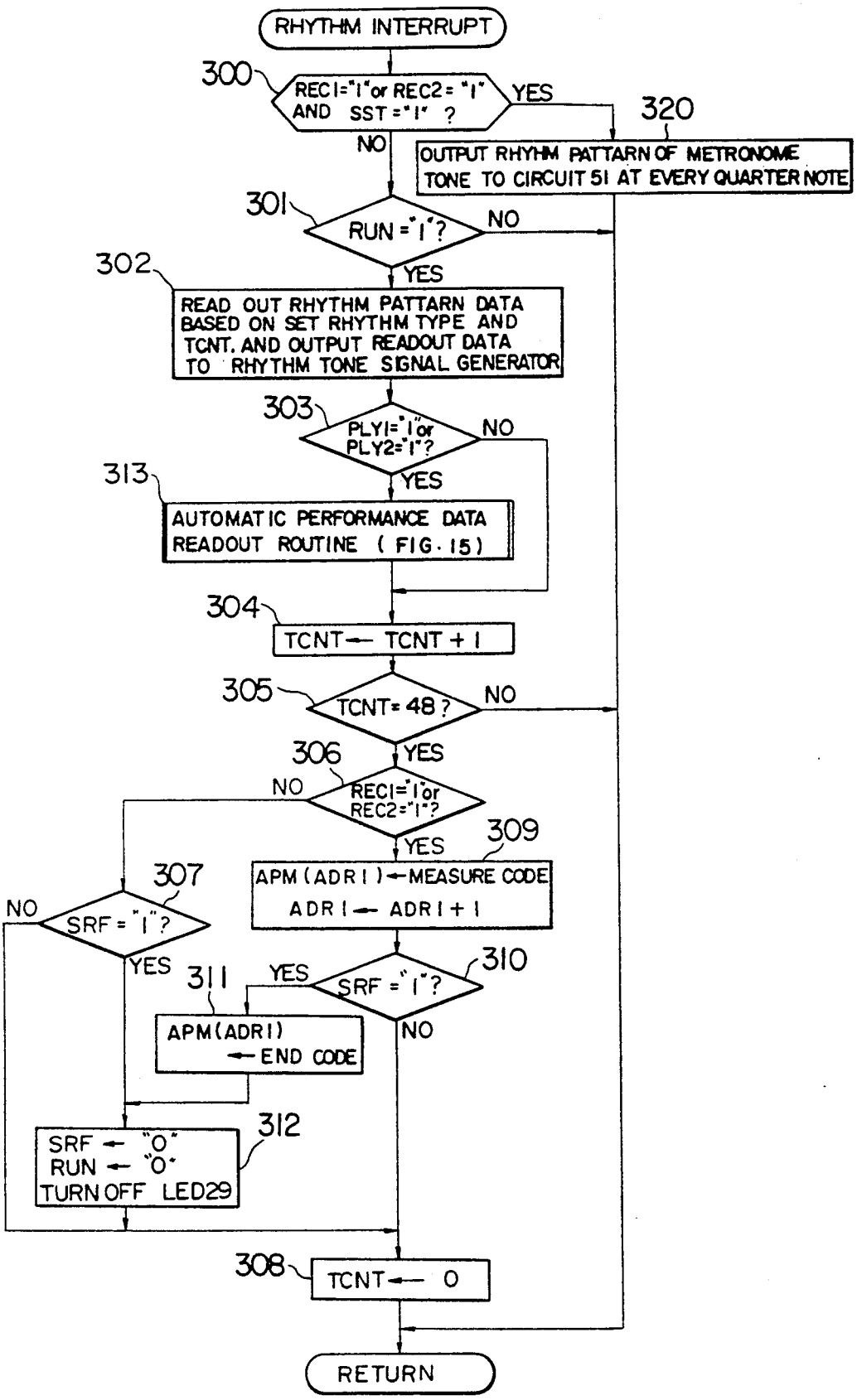

More specifically, when the tempo clock signal is output from the tempo oscillator 40, the CPU 72 is interrupted, and the control enters the rhythm interrupt processing routine shown in FIG. 12. In this routine, in step 300, it is checked if the record flag REC1 or REC2 is "1" and the synchro start flag SST is "1". In this case, since NO in step 300, the flow advances to step 301 to check if the rhythm run flag RUN is "1". If NO in step 301, the control returns to the main routine shown in FIG. 6. However, if YES in step 301, the flow advances to step 302. In step 302, rhythm pattern data is read out from the rhythm pattern data memory 61 on the basis of data indicating the rhythm type, which is presently set in the working memory 73, and the tempo count data TCNT. The readout rhythm pattern data is output to the rhythm tone signal generator 51. On the basis of the rhythm pattern data, percussion tone signal forming circuits in the rhythm tone signal generator 51 are driven, thus generating rhythm tones.

The flow then advances to step 303 to check if the play flag PLY1 or PLY2 is "1". Since NO in step 303, the flow advances to step 304, and the tempo count data TCNT is incremented. The flow advances to step 305 to check if the tempo count data TCNT is a measure end value "48". Since NO is determined in step 305, the flow returns to the main routine.

Thereafter, every time the tempo clock signal is generated, step 302 described above is executed to generate rhythm tones, and step 304 is then executed to increment the count data TCNT. When the tempo count data TCNT reaches "48", YES is determined in step 305, and the flow advances to step 306. It is checked in step 306 if the record flag REC1 or REC2 is "1". In this case, since NO in step 306, the flow advances to step 307 to check if the stop reserve flag SRF is "1". Since NO is determined in step 307, the flow advances to step 308, and the tempo count data TCNT is cleared. The flow then returns to the main routine.

Figure 13:
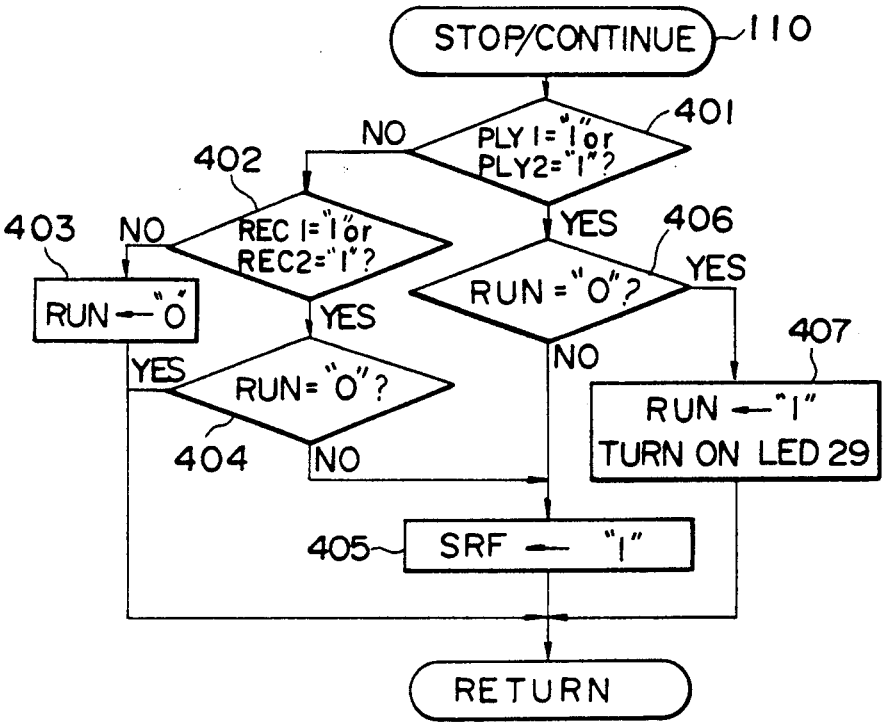

The rhythm tone generation procedures have been described. When the rhythm tones are to be stopped in the normal performance mode, the stop/continue switch 30 is depressed. When the stop/continue switch 30 is depressed, the flow advances from step 103 to a stop/continue processing routine in step 110 via step 104. FIG. 13 is a flow chart of this routine. In step 401, it is checked if the play flag PLY1 or PLY2 is "1". Since NO in step 401, the flow advances to step 402 to check if the record flag REC1 or REC2 is "1". If NO in step 402, the flow advances to step 403, and the rhythm run flag RUN is reset. When the rhythm run flag RUN is reset, step 302 in FIG. 12 is not executed, and rhythm tones are stopped. The flow returns to the main routine.

When one of the rhythm selection switches 22 is operated subsequently, the flow advances from step 103 to step 106 via step 104. In step 106, data indicating the rhythm type is set in the working memory 73 in correspondence with the operated rhythm selection switch 22. Thereafter, read access of the rhythm pattern data memory 61 is performed on the basis of the data set in the memory 73. When the tempo volume control 25 is operated, the flow also advances to step 106, and an oscillation frequency of the tempo oscillator 40 is set in accordance with an operation amount of the tempo volume control 25.

(2) Data Write Mode

In this mode, performance data is to be written in the area I or II of the performance data memory 62. When performance data is to be written in the area I, the LED **27*b* is turned off by the track switch 26*b*, and the LED 27*a* is turned on in red by the track switch 26*a*. When a performance is made using the keyboard 10 and the operation panel 20, performance data corresponding to the performance are sequentially written in the area I. In this case, there are two start methods. In one method, the start switch 28 is not operated. In this case, data write access and generation of rhythm tones are started simultaneously with an operation of the first keyboard key. In the other method, the start switch 28 is depressed. In this case, data write access and generation of rhythm tones are started simultaneously with depression of the start switch 28**.

When performance data is written in the area II, the LED **27*a* is turned off by the track switch 26*a*, and the LED 27*b* is turned on in red by the track switch 26*b*. Then, a performance is made using the keyboard 10 and the operation panel 20**.

The processing of the CPU 72 in the data write mode will be described below.

When the track switch **26*b* is operated to turn off the LED 27*b*, the mode data M2 is set "0", as can be seen from step 168 in FIG. 8, and the play flag PLY2, the record flag REC2, and the synchro start flag SST are respectively set "0". When the track switch 26*a* is operated to turn on the LED 27*a* in red, the mode data M1 is set "2", the play flag PLY1 is set to "0", and the record flag REC1 and the synchro start flag SST are respectively set "1", as can be seen from steps 154 and 156 in FIG. 7**.

When both the record flag REC1 and the synchro start flag SST are set "1", metronome tones are then generated at timings of quarter notes, thus informing a tempo to the performer. More specifically, when the tempo clock signal is output from the tempo oscillator 40, and the processing of the CPU 72 enters the interrupt routine shown in FIG. 12, a judgment in step 300 is made. In this case, since YES is determined in step 300, the flow advances to step 320. In step 320, a rhythm pattern of metronome tones is read out from the rhythm pattern memory 61 at every timing of a quarter note, and is output to the rhythm tone signal generator 51. In this manner, metronome tones are generated at the timings of quarter notes.

When a keyboard key is then operated, YES is determined in step 103 (FIG. 6), and the control enters the key/tone color event routine in FIG. 9 via step 104. In this routine, the processing in step 200 is executed, and the control then enters the musical tone signal output routine I (FIG. 10) in step 201 to execute the processing in step 602. Thus, a musical tone of the operated key is generated. The flow then advances to step 202. In this case, since YES in step 202, the flow advances to step 204 to check if the synchro start flag SST is "1". YES is determined in step 204, and the flow advances to step 205. In step 205, the synchro start flag SST is "0", the rhythm run flag RUN is set "1", and the tempo count data TCNT is cleared. When the synchro start flag SST is set "0", NO is determined in step 300 (FIG. 12), and metronome tones are no longer generated. When the rhythm run flag RUN is set "1", YES is determined in step 301, and generation of rhythm tones is started. The flow advances to step 206 to check if the record flag REC1 is "1". Since YES in step 206, the flow advances to step 207. In step 207, the record check flag DTARI1 is set "1", and the head address data HEADAD(I) (FIG. 4) is set as the address data ADR1. The flow then advances to step 209. Note that if NO in step 206, i.e., if the record flag REC2 is "1" (write mode of the area II), the flow advances to step 208, and the record check flag DTARI2 is set "1". In addition, the head address data HEADAD(II) is set as the address data ADR1.

The flow advances to step 209, and timing data (FIG. 5) consisting of the identification mark and the time data TIMD is written at the storage position APM(ADR1) of the memory 62 indicated by the address data ADR1. In this case, as the time data TIMD, the tempo count data TCNT is set. Therefore, at this time, the time data TIMD is "0" (see step 205). The flow then advances to step 210 to increment the address data ADR1. The flow then advances to step 211. In step 211, the first event data in the event buffer register IVTBUF is read out, and the readout data is written at the storage position APM(ADR1) of the memory 62 with the identification mark. In step 212, the first event data in the event buffer register IVTBUF is cleared. The flow then advances to step 213 to check if there is event data in the event buffer register IVTBUF. If YES in step 213, the processing in steps 210 to 212 is repeated. However, if NO in step 213, the flow advances to step 214, and the address data ADR1 is incremented. The flow advances to step 215 to check if the record flag REC1 is "1". If YES in step 215, the flow advances to step 216. In step 216, it is checked if the address data ADR1 corresponds to the end address of the area I. If NO in step 216, the flow returns to step 102 (FIG. 6); otherwise, the flow advances to step 217. In step 217, the record flag REC1 is reset, the LED **27*a* is turned off, and the end code is written at the storage position APM(ADR1) of the memory 62. The flow then returns to step 102. On the other hand, if NO in step 215, i.e., if the record flag REC2 is "1", a judgment in step 218 is made. If YES in step 218, the processing in step 219** is executed.

When the mode data M1 is set "2", the mode data M2 is set "0", and a keyboard key is operated, the rhythm run flag RUN is set "1" (step 205). Therefore, generation of rhythm tones is started, and event data associated with the operated key is written in the area I. Thereafter, every time the keyboard key or the switch on the operation panel 20 is operated, steps 209 to 213 are executed, and performance data is written in the area I.

When a bar timing is reached, YES is determined in step 305 in FIG. 12, and the flow advances to step 306. In this case, since YES is determined in step 306, the flow advances to step 309. In step 309, a measure code is written at the storage position APM(ADR1) of the performance data memory 62, and the address data ADR1 is then incremented.

When the address ADR1 reaches the end address of the area I, step 217 is executed to end the data write mode. If the data write mode is to be ended before the end address, the stop/continue switch 30 is depressed.

When the switch 30 is depressed, the control enters stop/continue processing in FIG. 13, and steps 401 and 402 are sequentially executed. The flow then advances to step 404. In step 404, it is checked if the rhythm run flag RUN is "0". In this case, NO is determined in step 404, and the flow advances to step 405. In step 405, the stop reserve flag SRF is set "1". The flow returns to the main routine. When the stop reserve flag SRF is set "1", YES is determined in step 310 (FIG. 12) at the next bar timing, and the flow advances to step 311. In step 311, the end code is written at the storage position APM-(ADR1) of the memory 62. The flow then advances to step 312 to reset the stop reserve flag SRF and the rhythm run flag RUN and to turn off the LED 29. The flow advances to step 308, and the tempo count data TCNT is cleared. The flow then returns to the main routine.

The performance data write procedures have been described. In the above procedures, after the mode is set, data write access and generation of rhythm tones are started upon depression of a keyboard key. Alternatively, after the mode is set, data write access and generation of rhythm tones may be started upon depression of the start switch 28.

More specifically, when the start switch 28 is depressed after the LED 27*a* is turned on in red (mode data M1 is set "2") and the LED 27*b* is turned off (M2 is set "0"), judgments in steps 251 and 252 in FIG. 11 are sequentially made, and the flow then advances to step 255. In step 255, the head address data HEADAD(I) is set as the address data ADR1. The flow advances to step 256. In step 256, the tempo count data TCNT is clealred, the rhythm run flag RUN is set, the synchro start flag SST is reset, and the LED 29 is turned off. The flow then returns to the main routine via steps 257 and 258.

In this manner, when the start switch 28 is depressed after the mode data M1 is set "2", the address datga ADR1 is set to be the head address of the area I, and the rhythm run flag RUN is set "1", thereby starting generation of rhythm tones. Thereafter, when a performance is made by operating the keyboard keys, performance data are sequentially written in the area in the same manner as described above.

Write access of the area I has been exemplified. The same applies to write access of the area II.

Figure 14:
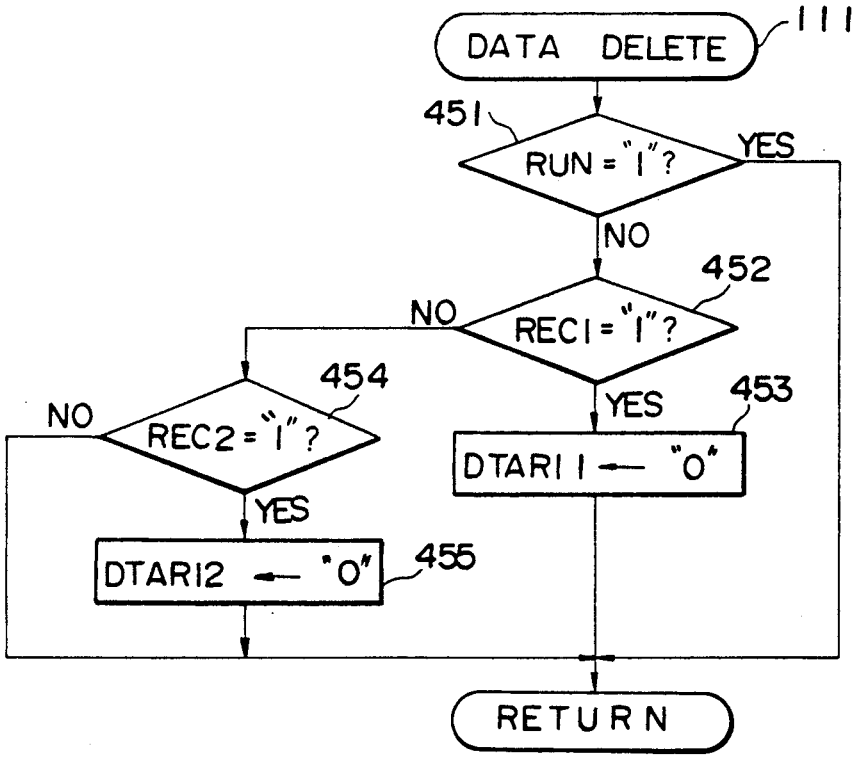

When all the data in the area I or II are to be deleted, the delete switch 31 shown in FIG. 3 is depressed. When the delete switch 31 is depressed, YES is determined in step 103, and the flow advances to step 111 via step 104, thus executing data delete processing. FIG. 14 is a flow chart showing the data delete processing. In step 451, it is checked if the rhythm run flag RUN is "1". If YES in step 451, the flow returns to step 102. More specifically, when rhythm tones are being generated, data cannot be deleted even if the delete switch 31 is depressed. If NO in step 451, however, the flow advances to step 452. In step 452, it is checked if the record flag REC1 is "1". If YES in step 452, i.e., if the data write mode of the area I is set, the flow advances to step 453, and the record check flag DTARI1 is set "0". The flow then returns to step 102. However, if NO in step 452, the flow advances to step 454. It is checked in step 454 if the record flag REC2 is "1". If YES in step 454, i.e., when the data write mode of the area II is set, the flow advances to step 455, and the record check flag DTARI2 is set "0". The flow then returns to step 102. If NO in step 454, i.e., if the write mode of neither the areas I nor II is set, the flow returns to step 102.

(3) Automatic Performance Mode

In this mode, performance data in the performance data memory 62 is read out, and an automatic performance is executed. When an automatic performance is to be executed on the basis of performance data in the area I of the performance data memory 62, the track switches 26*a* and 26*b* are operated to turn off the LED 27*b* (mode data M2="0") and to turn on the LED 27*a* in green (mode data M1="1"). When an automatic performance is to be executed on the basis of performance data in the area II, the LED 27*a* is turned off (mode data M1="0"), and the LED 27*b* is turned on in green (mode data M2="1"). Then, the start switch 28 is depressed.

A case will be exemplified below wherein an automatic performance based on the performance data in the area I is to be executed. When the mode data M2 is set at "0", step 168 in FIG. 8 is executed. When the mode data M1 is set at "1", YES is determined in step 151 in FIG. 7, and the flow advances to step 152. It is checked in step 152 if the record check flag DTARI1 is "1". If YES in step 152, i.e., if the performance data have already been written in the area I, the flow advances to step 153. In step 153, the play flag PLY1 is set, the record flag REC1 is reset, and the LED 27*a* is turned on in green.

When the start switch 28 is depressed, the flow advances to step 251 in FIG. 11 to check if the play flag PLY1 or PLY2 is "1". In this case, YES is determined in step 251, and the flow advances to step 259. In step 259, the head address data HEADAD(I) is set as the address data ADR1, and the head address data HEADAD(II) is set as the address data ADR2. After processing in step 256 is executed, the flow advances to step 257 to check if the play flag PLY1 is "1". Since YES is determined in step 257, the flow advances to step 260. In step 260, data at the storage position APM(ADR1) of the memory 62 indicated by the address data ADR1 (in this case, the head address data HEADAD(I)) is read out, and is set as the read timing data RDTIM1. The flow advances to step 258 to check if the play flag PLY2 is "1". Since NO in step 258, the flow returns to step 102 (FIG. 6). When YES is determined in step 258, i.e., when an automatic performance is executed based on performance data in the area II, the flow advances to step 261. In step 261, data at the storage position APM-(ADR2) indicated by the address data ADR2 is read out, and is set as the read timing data RDTIM2.

In this manner, when the automatic performance mode of the area I is set and the start switch 28 is depressed, the play flag PLY1 is set, and the rhythm run flag RUN is then set. When these flags PLY1 and RUN are set, automatic performance tones and rhythm tones are generated on the basis of the tempo clock signals output from the tempo oscillator 40.

Figure 15:
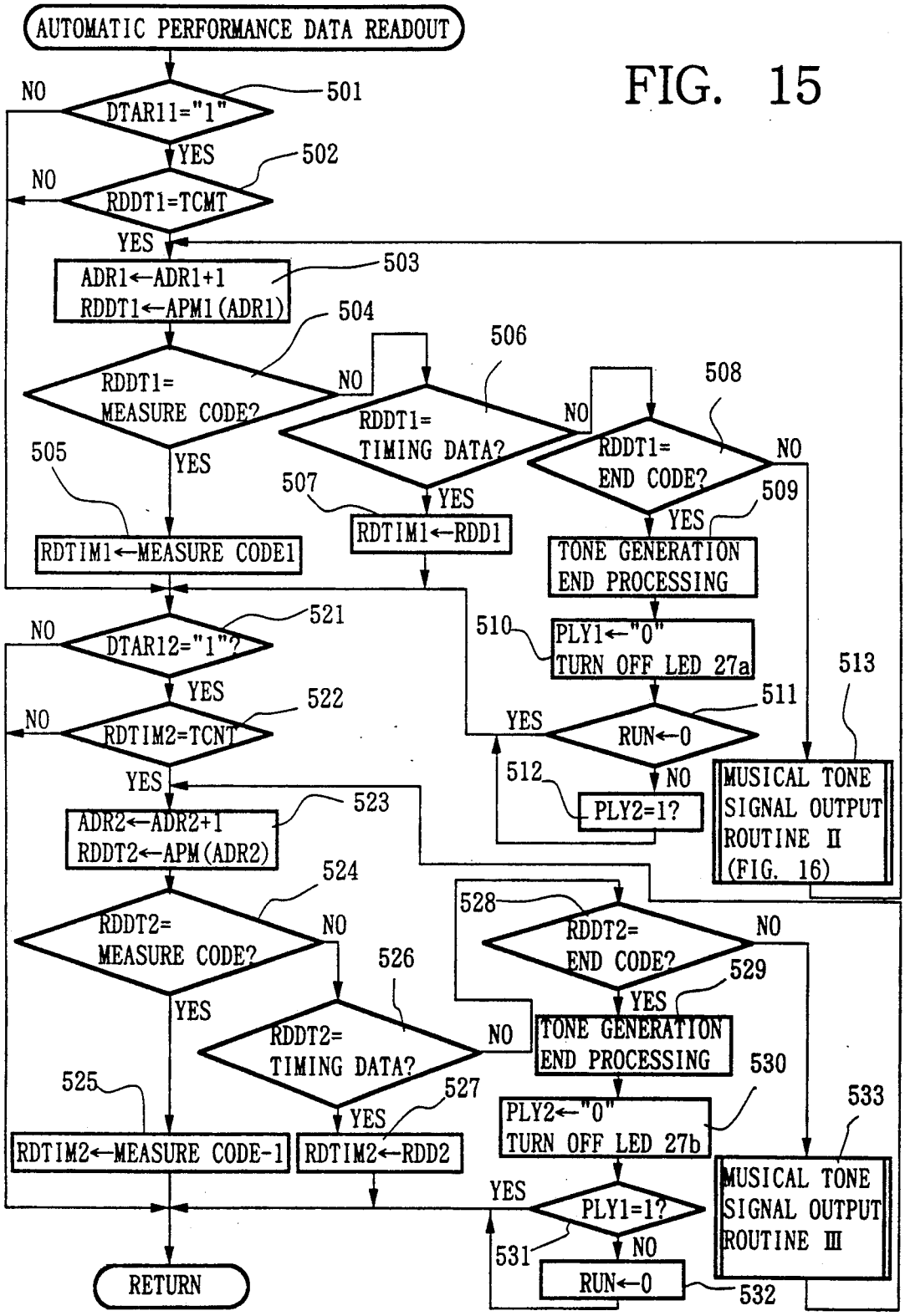

More specifically, when the tempo clock signal is generated, the CPU 72 is interrupted, and the rhythm interrupt processing shown in FIG. 10 is executed. In this case, the flow advances to step 302 via steps 300 and 301, and rhythm tones are generated. The flow then advances to step 303. Since YES is determined in step 303, the control enters an automatic performance data readout routine in step 313. FIG. 15 is a flow chart showing in detail the automatic performance data readout routine in step 313. The routine in step 313 consists of a readout routine RI for reading out data in the area I of the memory 62, and a readout routine RII for reading out data in the area II. Note that the routines RI and RII have substantially the same processing content except for flags and data.

When the control enters the routine in step 313, it is checked in step 501 if the record check flag DTARI1 is "1". If NO in step 501, i.e., if there is no performance data in the area I, the flow jumps to the routine RII while skipping the routine RI. If YES in step 501, the flow advances to step 502. It is checked in step 502 if the tempo count data TCNT is equal to the read timing data RDTIM1. If NO in step 502, the control exits the routine RI and enters the routine RII. However, if YES in step 502, the flow advances to step 503. In step 503, the address data ADR1 is incremented. Data at the storage position APM(ADRI) of the memory 62 is read out, and is set as the read data RDDT1. The flow then advances to step 504 to check if the read data RDDT1 is a measure code. If YES in step 504, the flow advances to step 505. In step 505, a value "47" obtained by subtracting "1" from the measure end value "48" is set as the read timing data RDTIM1, and the control exits the routine RI. If NO in step 504, the flow advances to step 506 to check if the read data RDDT1 is timing data. If YES in step 506, the flow advances to step 507, and the read data RDDT1 is set as the read timing data RDTIM1. If NO in step 506, the flow advances to step 508 to check if the read data RDDT1 is an end code. If YES in step 508, the flow advances to step 509 to execute tone generation end processing. More specifically, key-OFF data for instructing to stop generation of musical tones which are being generated is output to the pitch data register APREG1 in the automatic performance musical tone signal generator 53*a*. Thus, the register APREG1 is cleared, and musical tones are stopped. The flow then advances to step 510 to clear the play flag PLY1 and to turn off the LED 27*a*. In step 511, it is checked if the play flag PLY2 is "1". If YES in step 511, the control exits the routine RI. If NO in step 511, the flow advances to step 512 to reset the rhythm run flag RUN. The control then exits the routine RI. If NO in step 508, the control enters a musical tone signal output routine II in step 513.

Figure 16:
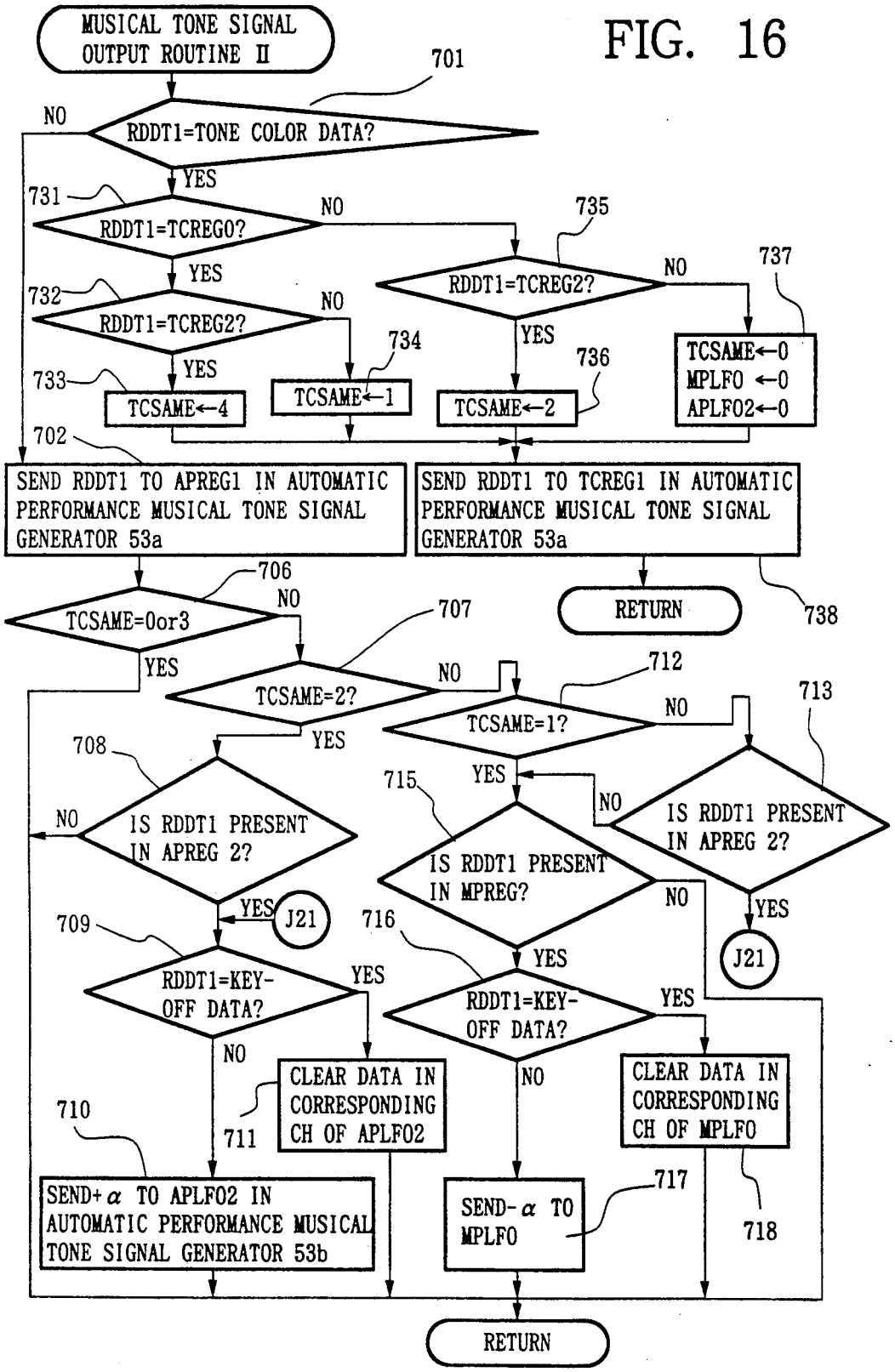

FIG. 16 is a flow chart of the musical tone signal output routine II. In step 701, it is checked if the read data RDDT1 is tone color data. If NO in step 701, the flow advances to step 702. In step 702, the read data RDDT1 is sent to the pitch data register APREG1 in the automatic performance musical tone signal generator 53*a*. Then, detune processing II in steps 706 to 718 (to be described later) is executed, and the flow returns to step 503 in FIG. 15. If YES in step 701, the flow advances to step 731. After tone color comparison processing II in steps 731 to 737 (to be described later) is executed, the read data RDDT1 is sent to the tone color data register TCREG1 in the automatic performance musical tone signal generator 53*a*. The flow then returns to step 503 in FIG. 15.

In this manner, when the control enters the automatic performance data readout routine (step 313), the flow advances to step 502 via step 501. If NO in step 502, the control exits the routine RI. More specifically, no tone generation processing is performed at all until the tempo count data TCNT coincides with the read timing data RDTIM1. The data TCNT is incremented in step 304 every time the interrupt processing shown in FIG. 12 is executed once. As a result, when the data TCNT coincides with the data RDTIM1, the next performance data is read out from the area I (step 503). When this performance data is, e.g., performance data of a key-ON event, the data is output to the automatic performance musical tone signal generator 53*a* in step 513, thus generating a musical tone. When the readout data is timing data, the processing in step 507 is executed. Thereafter, no tone generation processing is executed until the tempo count data TCNT coincides with the read timing data RDTIM1 set in step 507. When the data TCNT coincides with the data RDTIM1 again, the same tone generation processing as described above is executed, and an automatic performance I is executed by repeating the above processing.

When data read out from the area I is a measure code, the read timing data RDTIM1 is set to be "47". As a result, no tone generation processing is executed until the next bar timing. When the next bar timing is reached, data is read out from the area I. In this case, timing data or a measure code is read out. When the timing data is read out, no data read access is performed until the tempo count data TCNT coincides with the timing data; when the readout data is a measure code, no data read access is made during the next one measure.

When data read out from the area I is an end code, processing in steps 509 to 512 is executed, thus ending the automatic performance mode.

The processing in the routine RI has been described. With this processing, an automatic performance I (AP1) is executed on the basis of performance data in the area I. Contrary to this, the routine RII is processing for executing an automatic performance II (AP2) based on performance data in the area II. Therefore, when only the routine RI is executed, musical tones based on performance data in the area I are generated. When only the routine RII is executed, musical tones based on performance data in the area II are generated. When both the routines RI and RII are executed, musical tones based on performance data in the areas I and II are simultaneously generated.

When an automatic performance is to be stopped during the automatic performance (before the end code is read out), the stop/continue switch 30 is depressed. When the stop/continue switch 30 is depressed, the flow advances from step 104 in FIG. 6 to step 401 in FIG. 13. In this case, since YES in step 401, the flow advances to step 406. It is checked in step 406 if the rhythm run flag RUN is "0". Since NO in step 406, the flow advances to step 405, and the stop reserve flag SRF is set ""1". The flow then returns to step 102. When the stop reserve flag SRF is set "1", YES is determined in step 307 in FIG. 12 at the next bar timing, and the flow advances to step 312. In step 312, the stop reserve flag SRF and the rhythm run flag RUN are reset, and the LED 29 is turned off. When the rhythm run flag RUN is reset, steps 302 and 313 in FIG. 12 are no longer executed, and hence, rhythm tones and automatic performance tones are stopped.

When the stop/continue switch 30 is depressed again, steps 401 and 406 in FIG. 13 are sequentially executed. Since YES is determined in step 406, the flow advances to step 407. In step 407, the rhythm run flag RUN is set "1" again, and the LED 29 is turned on. When the rhythm run flag RUN is set, generation of rhythm tones and automatic performance tones is restarted. In this case, the address data ADR1 and ADR2, the read data RDDT1 and RDDT2, and the read timing data RDTIM1 and RDTIM2 are left unchanged after the stop/continue switch 30 was depressed to stop the automatic performance. Therefore, when the rhythm run flag RUN is set "1" again, a music piece restarts from the stopped portion.

In this manner, when the stop/continue switch 30 is depressed during the automatic performance, the automatic performance is stopped, and is restarted upon the next depression of the switch 30. Thereafter, this operation is repeated every time the stop/continue switch 30 is depressed. When the automatic performance is to be executed from the beginning after the automatic performance is stopped, the stop switch 28 can be depressed.

(4) Ensemble Mode

In this performance apparatus, an ensemble with an arbitrary combination of a performance (manual performance) using the keyboard 10 and the operation panel 20, an automatic performance (automatic performance I) based on performance data in the area I, and an automatic performance (automatic performance II) based on performance data in the area II is available.

For example, when the track switch 26*a* is operated to turn on the LED 27*a* in green, the start switch 28 is operated to start an automatic performance I (AP1), and a manual performance (MP) is started, an ensemble of the AP1 and MP can be executed. When the LEDs 27*a* and 27*b* are turned on in green to start the automatic performances (AP1 and AP2) and the manual performance (MP) is started, a trio ensemble of the MP, AP1, and AP2 can be executed. When all or part of performance parts are set in the same tone color, polyphonic ensemble tones can be generated.

In the ensemble mode, when one of the tone color selection switches 23 is operated, YES is determined in step 103 in FIG. 6, and the control enters the key/tone color event routine in FIG. 9 via step 104. Furthermore, the control enters the musical tone signal output routine I in FIG. 10 via step 201. In this routine, since YES is determined in step 601, the control enters the tone color comparison processing I consisting of steps 630 to 637. In step 630, tone color event data in the event buffer register IVTBUF is stored in the tone color event register TC. The flow advances to step 631 to check if the tone color event data TC coincides with the AP1 tone color data TCREG1 set in the automatic performance musical tone signal generator 53*a*. If YES in step 631, the flow advances to step 632. In step 632, it is checked if the tone color event data TC coincides with the AP2 tone color data TCREG2 in the automatic performance musical tone signal generator 53*b*. If YES in step 632, the flow advances to step 633; otherwise, the flow advances to step 634. In step 633, the data "4" indicating that tone colors of the three musical tones for the MP, AP1, and AP2 are the same is set as the tone color comparison data TCSAME. In step 634, the data "1" indicating that tone colors of the musical tones for the MP and AP1 are the same is set as the tone color comparison data TCSAME. If NO in step 631, the flow advances to step 635 to check if the tone color event data TC coincides with the AP2 tone color data TCREG2 in the automatic performance musical tone signal generator 53*b*. If YES in step 635, the flow advances to step 636; otherwise, the flow advances to step 637. In step 636, the data "3" indicating that tone colors of the musical tones for the MP and AP2 are the same is set as the tone color comparison data TCSAME. In step 637, the data "0" indicating that tone colors of all the musical tones are different from each other is set as the tone color comparison data TCSAME, and the MP detune amount register MPLFO and AP2 detune amount register APLF02 are cleared. When the tone color comparison processing I is completed, the flow advances to step 638, and the tone color event data TC is sent to the MP tone color data register TCREG0 in the keyboard musical tone signal generator 52. Thereafter, the flow returns to step 638.

In this manner, in the tone color comparison processing I in steps 630 to 637, the tone color comparison data register TCSAME is set in accordance with the relationship among tone colors of three musical tones for the MP, AP1, and AP2. In step 638, the tone color of the keyboard musical tone signal generator 52 is set to be new tone color data TCREG0 in accordance with the operation of a tone color selection switch 23.

When a key on the keyboard 10 is operated, since NO is determined in step 601 in the musical tone signal output routine I (FIG. 10), the flow advances to step 602. In step 602, all the key events in the event buffer register IVTBUF are sent to the MP pitch data register MPREG in the keyboard musical tone signal generator 52. The control then enters the detune processing consisting of steps 603 to 620. In step 603, the control variable A is cleared. The flow then advances to step 604, so that key event data at the storage position IVTBUF(A) in the event buffer register IVTBUF is read out and is stored in the key buffer KBUF. In step 605, it is checked if there is data at the storage position IVTBUF(A). Since NO in step 605, the flow advances to step 606. In step 606, it is checked if the tone color comparison data TCSAME is "0" or "2". If YES in step 606, the flow advances to step 620; otherwise, the flow advances to step 607. It is checked in step 607 if the tone color comparison data TCSAME is "3". If NO in step 607, the flow advances to step 612; otherwise, the flow advances to step 608. In step 608, it is checked if the AP2 pitch data register APREG2 in the automatic performance musical tone signal generator 53*b* stores the same pitch data as the key event data KBUF. If NO in step 608, the flow advances to step 620; otherwise, the flow advances to step 609. It is checked in step 609 if the key event data KBUF is a key-OFF event. If YES in step 609, the flow advances to step 610; otherwise, the flow advances to step 611. In step 610, a detune amount ($-\alpha$) is sent to a corresponding channel of the detune amount register MPFLO in the keyboard musical tone signal generator 52. In step 611, data in the corresponding channel of the detune amount register MPFLO is cleared. Upon completion of the processing in step 610 or 611, the flow advances to step 620. When the flow advances to step 612 according to "NO" determined in step 607, it is checked if the tone color comparison data TCSAME is "1". If YES in step 612, the flow advances to step 615; otherwise, the flow advances to step 613. In step 613, it is checked if the AP2 pitch data register APREG2 of the automatic performance musical tone signal generator 53b stores the same pitch data as the key event data KBUF. If YES in step 613, the flow advances to step 609, and the above-mentioned processing is executed. However, if NO in step 613, the flow advances to step 615. In step 615, it is checked if the AP1 pitch data register APREG1 of the automatic performance musical tone signal generator 53a stores the same pitch data as the key event data KBUF. If YES in step 615, the flow advances to step 609; otherwise, the flow advances to step 620. In step 620, the control variable A is incremented. The flow then returns to step 604, and loop processing in steps 604 to 620 is repeated. When the loop processing in steps 604 to 620 is repeated by the number of times corresponding to the number of key events fetched in step 200, YES is determined in step 605, and the flow returns from step 605 to step 202, thus ending the detune processing I and the musical tone signal output routine I.

In this manner, when the keyboard 10 is operated to generate MP performance data, the pitch data MPREG and tone color data TCREG0 if the MP performance data are compared with AP performance data (APREG1, TCREG1, APREG2, and TCREG2) in the automatic performance musical tone signal generators 53a and 53b which are now generating tones. When AP performance data having the same pitch and the same tone color as those of the MP performance data is detected, the detune amount ($-\alpha$) is set in the detune amount register MPFLO of the corresponding channel of the keyboard musical tone signal generator 52. Thus, an MP musical tone is detuned by $-\alpha$. When the detuned MP musical tone is mixed with AP musical tones, a beat of a frequency corresponding to $\alpha$ or $2\alpha$ (see detune processing II and III to be described later) is caused, thus generating polyphonic musical tones.

When performance data read out from the area I in step 503 in the automatic performance data readout routine in FIG. 15 is a key event or tone color event, the control enters the musical tone signal output routine II in FIG. 16 via step 513. It is checked in step 701 if the read data RDDT1 is tone color data. If YES in step 701, tone color comparison processing II in steps 731 to 737 and processing in step 738 are executed, and the flow then returns to step 503. The processing contents of these tone color comparison processing II and step 738 are substantially the same as those in the tone color comparison processing I in steps 631 to 637 and step 738 described above except for flags and data.

However, if NO in step 701, the flow advances to step 702, and the performance data (key event data) RDDT1 is sent to the AP1 pitch data register APREG1 in the automatic performance musical tone signal generator 53a. The flow advances to step 706 to check if the tone color comparison data TCSAME is "0" or "3". If NO in step 706, the flow advances to step 707; otherwise, the flow returns to step 503. It is checked in step 707 if the tone color comparison data TCSAME is "2". If YES in step 707, the flow advances to step 708. In step 708, it is checked if the AP2 pitch data register APREG2 of the automatic performance musical tone signal generator 53b stores the same pitch data as the key event data RDDT1. If YES in step 707, the flow advances to step 709; otherwise, the flow returns to step 503. It is checked in step 709 if the key event data KBUF is a key-OFF event. If YES in step 709, the flow advances to step 710; otherwise, the flow advances to step 711. In step 710, a detune amount ($+\alpha$) is sent to the corresponding channel of the detune amount register APFL02 in the automatic performance musical tone signal generator 53b. In step 711, the data in the corresponding channel of the detune amount register APFL02 is cleared. Upon completion of the processing in step 710 or 711, the flow returns to step 503. If NO in step 707, the flow advances to step 712. In step 712, it is checked if the tone color comparison data TCSAME is "1". If YES in step 712, the flow advances to step 715; otherwise, the flow advances to step 713. In step 713, it is checked if the AP2 pitch data register APREG2 of the automatic performance musical tone signal generator 53b stores the same pitch data as the key event data RDDT1. If YES in step 713, the flow advances to step 709 to execute the above-mentioned processing. However, if NO in step 713, the flow advances to step 715. It is checked in step 715 if the MP pitch data register MPREG of the keyboard musical tone signal generator 52 stores the same pitch data as the key event data RDDT1. If YES in step 715, the flow advances to step 716; otherwise, the flow returns to step 503. In step 716, it is checked if the key event data RDDT1 is a key-OFF event. If YES in step 716, the flow advances to step 717; otherwise, the flow advances to step 718. In step 717, a detune amount ($-\alpha$) is sent to the corresponding channel of the detune amount register MPFLO in the keyboard musical tone signal generator 52. In step 718, the data in the corresponding channel of the detune amount register MPFLO is cleared. Upon completion of the processing in step 717 or 718, the flow returns to step 503.

In this manner, when AP1 performance data is read out from the area I, pitch data APREG1 and tone color data TCREG1 of the AP1 performance data are compared with MP performance data (TCREG0 and MPREG) of the keyboard musical tone signal generator 52 and AP2 performance data (TCREG2 and APREG2) of the automatic performance musical tone signal generator 53b, which are now generating tones. When an AP2 musical tone having the same pitch and same tone color as those of the AP1 musical tone to be generated is detected, a detune amount ($+\alpha$) is set in the detune amount register APFL02 in the corresponding channel of the automatic performance musical tone signal generator 53b. Thus, the AP2 musical tone is detuned by $+\alpha$. When the detuned musical tone is mixed with the AP1 musical tone, a beat of a frequency corresponding to $\alpha$ is caused, thus generating polyphonic musical tones. When the AP1 musical tone having the same pitch and the same tone color as those of the AP2 musical tone is to be keyed off, the detune amount register APFL02 in the corresponding channel of the automatic performance musical tone signal generator 53b is cleared. Thus, the detuned musicals tone can be prevented from being solely produced. When MP performance data having the same pitch and the same tone color as those of this AP1 performance data is detected, a detune amount ($-\alpha$) is set in the detune amount register MPFLO in the corresponding channel of the keyboard musical tone signal generator 52. Thus, an MP musical tone is detuned by $-\alpha$, and when the detuned musical tone is mixed with the AP musical tones, a beat of a frequency corresponding to $\alpha$ is caused, thus generating polyphonic musical tones. When the AP1 musical tone having the same pitch and the same tone color as those of the MP musical tone is to be keyed off, if there is no AP2 musical tone having the same pitch and the same tone color, the corresponding channel of the detune amount register APFL02 of the keyboard musical tone signal generator 52 is cleared. Thus, the detuned MP musical tone can be prevented from being solely produced.

Figure 17:
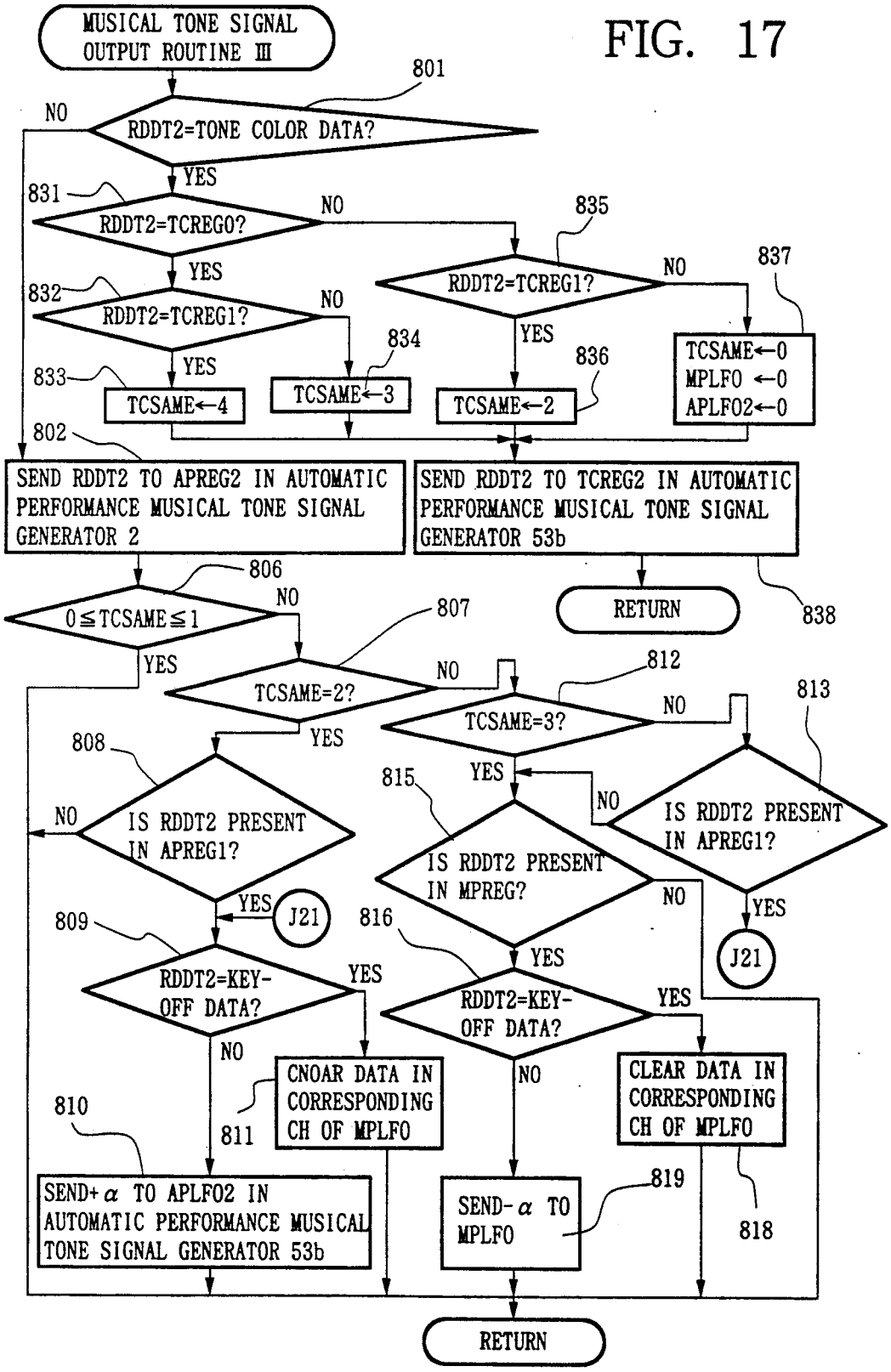

In step 523 in the automatic performance data read-out routine in FIG. 15, when performance data read out from the area II is a key event or tone color event, the control enters a musical tone signal output routine III in FIG. 17 via step 533. The processing content of the musical tone signal output routine III is substantially the same as that of the musical tone signal output routine II shown in FIG. 16 except for flags and data.

ANOTHER EMBODIMENT

The present invention is not limited to the above embodiment, and various changes and modifications may be made within the spirit and scope of the invention. For example, in the above description, a constant detune amount is set but a detune amount may be varied by a volume control. Two detune amounts are set to be $-\alpha$ and $+\alpha$ but may be set to have different absolute values. Only when three musical tones overlap each other, one or two tones may be detuned. Alternatively, when a plurality of musical tones overlap each other, only one tone may be detuned.

In the above description, parts to be detuned are fixed. However, parts to be detuned may be determined in accordance with an input order or a decay amount of a musical tone like in conventional key assignment processing.

In the above description, an ensemble with an arbitrary combination of one manual performance and two automatic performances has been exemplified. The present invention can be applied to an ensemble with any combinations of one or a plurality of manual performances and one or a plurality of automatic performances, an ensemble by only a plurality of manual performances, e.g., upper, lower, and foot keyboards of a single electronic musical instrument, and an ensemble by only a plurality of automatic performances. In this case, a single electronic musical instrument or an automatic performance apparatus with a MIDI terminal is used as a tone source apparatus, and another keyboard, an electronic musical instrument, an automatic performance playback apparatus, a computer system, or the like with a MIDI terminal is connected thereto, thereby constituting a performance system.

In place of detuning, the amplitude or frequency of some parts before mixing may be modulated to change a tone color. Alternatively, one of musical tones having the same pitch and the same tone color may be amplitude- or frequency-modulated to change its tone color, and the modulated tone may be produced in place of a mixed tone of a plurality of musical tones. Alternatively, two or more types of tone colors for a single tone and multiple tones may be set and selectively used.

What is claimed is:

1. A performance apparatus comprising:

a musical tone forming means for forming musical tone signals based on a plurality of key data, a mixing means for mixing the musical tone signals, and a producing means for producing the mixed musical tone signal;

a comparison means for detecting a plurality of key data corresponding to musical tones having the same pitch and a predetermined tone color relationship from the key data of musical tones to be mixed; and a modulation means for changing at least one tone element of the mixed musical tone signal to be produced from said producing means on the basis of the key data detected by said comparison means.

2. An apparatus according to claim 1, wherein the plurality of key data include key data generated by one or a plurality of manual keys and key data output from one or a plurality of automatic performance apparatuses.

3. An apparatus according to claim 1, wherein said modulation means comprises detune means for detuning pitches of at least one of a plurality of musical tones formed based on the plurality of key data detected by said comparison means.

4. An apparatus according to claim 1, wherein said modulation means comprises means for modulating an amplitude or a frequency of the musical tone signal formed and mixed based on the plurality of key data detected by said comparison means.

5. A performance apparatus comprising:

musical tone forming means for forming musical tone signals based on a plurality of key data, mixing means for mixing the musical tone signals and producing means for producing the mixed musical tone signal;

comparison means for detecting when a plurality of key data corresponding to musical tones to be mixed have the same pitch and a predetermined tone color relationship; and modulation means for, when the comparison means detects that at least three key data corresponding to at least three musical tone elements have the same tone pitch and the same or similar tone colors, modulating at least one tone element of said at least three tone elemnts of the mixed musical tone signal to be produced in such a manner that at least two of said at least three tone elements are differentiated from each other.

6. A performance apparatus comprising:

musical tone forming means for forming musical tone signals based on a plurality of key data, mixing means for mixing the musical tone signals and producing means for producing the mixed musical tone signal;

comparison means for detecting when a plurality of key data corresponding to musical tones to be mixed have the same pitch and a predetermined tone color relationship; and detune means for, when the comparison means detects that three key data corresponding to three musical tone elements have the same tone pitch, detuning two of said three tone elements of the mixed musical tone signal by different amount from each other.

7. An apparatus according to claim 6, wherein one of said two tone elements is detuned to be higher and the other is detuned to be lower.

8. A performance apparatus comprising:

musical tone forming means for forming musical tone signals based on a plurality of key data, mixing means for mixing the musical tone signals and producing means for producing the mixed musical tone signal;

comparison means for detecting when a plurality of key data corresponding to musical tones to be mixed have the same pitch and a predetermined tone color relationship; and detune means for, when the comparison means detects that at least three key data corresponding to at least three musical tone elements have the same tone pitch detuning at least two of said at least three musical tone elements of the mixed musical tone signal in such a manner that at least two of said at least three tone elements of the mixed tone signal are produced in different detune amounts from each other.

9. A performance apparatus as in claim 1 wherein the predetermined tone color relationship is that musical tones to be mixed have the same tone color.

10. A performance apparatus as in claim 5 wherein the predetermined tone color relationship is that musical tones to be mixed have the same tone color.

11. A performance apparatus as in claim 6 wherein the predetermined tone color relationship is that musical tones to be mixed have the same tone color.

12. A performance apparatus as in claim 8 wherein the predetermined tone color relationship is that musical tones to be mixed have the same tone color.

* * * * *

UNITED STATES PATENT AND TRADEMARK OFFICE

CERTIFICATE OF CORRECTION

PATENT NO. : 5,159,142

DATED : October 27, 1992

INVENTOR(S) : Takashi Ishida

It is certified that error appears in the above-indentified patent and that said Letters Patent is hereby corrected as shown below:

On the Title page, and in col. 1, line 3, the word "LONE" should be corrected to read as --TONE--.

Signed and Sealed this

Twelfth Day of October, 1993

*Attest:*

*Attesting Officer*

Bruce Lehman

BRUCE LEHMAN

*Commissioner of Patents and Trademarks*